US011634266B2

(12) United States Patent
Kulangara et al.

(10) Patent No.: US 11,634,266 B2
(45) Date of Patent: Apr. 25, 2023

(54) THERMALLY INSULATED SHIPPING SYSTEM FOR PARCEL-SIZED PAYLOAD

(71) Applicant: Cold Chain Technologies, LLC, Franklin, MA (US)

(72) Inventors: Jeena Kulangara, Framingham, MA (US); Yuri McGarry, Wrentham, MA (US); James Robert Chasteen, Grosse Pointe Farms, MI (US); Stephen Kolb, Geneva, IL (US)

(73) Assignee: COLD CHAIN TECHNOLOGIES, LLC, Franklin, MA (US)

( * ) Notice: Subject to any disclaimer, the term of this patent is extended or adjusted under 35 U.S.C. 154(b) by 0 days.

(21) Appl. No.: 16/746,414

(22) Filed: Jan. 17, 2020

(65) Prior Publication Data

US 2020/0231362 A1 Jul. 23, 2020

Related U.S. Application Data

(60) Provisional application No. 62/793,560, filed on Jan. 17, 2019.

(51) Int. Cl.
*B65D 81/18* (2006.01)
*F25D 3/08* (2006.01)
(Continued)

(52) U.S. Cl.
CPC ..... *B65D 81/3825* (2013.01); *B65D 81/18* (2013.01); *F25D 3/06* (2013.01); *F25D 3/08* (2013.01); *F25D 2331/804* (2013.01)

(58) Field of Classification Search
CPC ..... F28D 21/00; B29C 44/569; B65D 81/3825; B65D 81/18; B65D 81/3853;
(Continued)

(56) References Cited

U.S. PATENT DOCUMENTS 85,914 A * 1/1869 Davis ..... F25D 23/062 217/129
307,299 A * 10/1884 Hare ..... B65D 9/10 217/128
(Continued)

FOREIGN PATENT DOCUMENTS

BE 1009382 A3 3/1997
BE 1019423 A3 7/2012
(Continued)

OTHER PUBLICATIONS

International Search Report dated Apr. 20, 2020 in corresponding PCT Application No. PCT/US2020/014154.
(Continued)

*Primary Examiner* — Gideon R Weinerth
(74) *Attorney, Agent, or Firm* — Kriegsman & Kriegsman

(57) ABSTRACT

Shipping container for a temperature-sensitive payload. In one embodiment, the shipping container includes an insulated base having a bottom wall and four side walls. A first thermally conductive member is positioned on the bottom wall. A payload box is centered on top of the first thermally conductive member, and four frozen packs, each having a thickness matching the height of the payload box, are positioned along the four sides of the payload box. An insulating frame may be placed around the payload box to keep the frozen packs from directly contacting the payload box. A second thermally conductive member is positioned on top of the payload box and the four frozen packs, and an insulated lid is positioned on top of the second thermally conductive member and the four side walls of the base. One, both or neither of the thermally conductive members may be removed to optimize seasonal suitability.

39 Claims, 31 Drawing Sheets

(51) Int. Cl.
*F25D 3/00* (2006.01)
*F25D 3/06* (2006.01)
*B65D 81/38* (2006.01)

(58) Field of Classification Search
CPC ..... B65D 85/78; B65D 81/3816; F25D 3/06; F25D 3/08; F25D 2331/804; F25D 2303/0843
USPC ..... 220/592, 592.2, 592.01; 217/128–130; 62/529, 438, 457.7, 457.1, 372
See application file for complete search history.

(56) References Cited

U.S. PATENT DOCUMENTS 333,123 A * 12/1885 Goldsmith ..... F25D 3/08 62/331
591,581 A * 10/1897 Larrance ..... A23G 9/225 217/3 BC
712,921 A * 11/1902 Florang ..... B65D 9/10 217/128
1,027,660 A * 5/1912 Larrance ..... F25D 3/08 217/129
1,036,631 A * 8/1912 Jackson ..... B65D 81/18 220/592.01
1,376,577 A * 5/1921 Pun ..... F25D 3/08 217/129
1,478,770 A * 12/1923 Steel ..... F25D 3/08 217/128
1,642,414 A * 9/1927 Florang ..... F25D 3/08 217/128
1,731,578 A * 10/1929 Kennedy ..... F25D 3/14 220/592.14
1,865,688 A * 7/1932 Hannaford ..... B65D 5/566 229/122.34
2,024,082 A * 12/1935 Woodruff ..... F25D 3/06 62/326
2,024,397 A * 12/1935 Snyder ..... B65D 81/18 62/372
2,031,254 A 2/1936 Derr
2,045,627 A 6/1936 Wooll
RE20,215 E 12/1936 Wooll
2,322,345 A 4/1937 Cage
2,216,330 A * 10/1940 Stover ..... B65D 81/3893 383/110
2,289,060 A * 7/1942 Merkle ..... F25D 3/14 426/109
2,317,005 A * 4/1943 Wasserman ..... B65D 81/3853 229/941
2,717,114 A 9/1955 Parham, Jr.
2,766,921 A 10/1956 Jones et al.
2,850,885 A * 9/1958 Mohr ..... F25D 3/14 62/372
2,930,707 A 3/1960 Linnell et al.
3,236,206 A 2/1966 Willinger
3,399,546 A * 9/1968 Kuns ..... F25D 3/08 62/529
3,406,532 A * 10/1968 Bridges ..... F25D 3/08 62/457.2
3,512,696 A 5/1970 Ebert
3,678,703 A * 7/1972 Cornish ..... F25D 3/00 62/371
3,889,743 A 6/1975 Presnick
3,974,658 A 8/1976 Starrett
4,019,340 A * 4/1977 Conklin ..... F25D 3/00 62/457.2
4,145,895 A 3/1979 Hjertstrand et al.
4,407,133 A 10/1983 Edmonson
4,509,587 A * 4/1985 Clark ..... F25D 3/06 165/47
4,576,017 A 3/1986 Combs et al.
4,682,708 A 7/1987 Pool
4,862,674 A 9/1989 Lejondahl et al.
4,928,847 A 5/1990 Hollander et al.
5,000,372 A 3/1991 Hollander et al.
5,024,865 A 6/1991 Insely
5,050,387 A 9/1991 Bruce
5,102,004 A 4/1992 Hollander et al.
5,111,957 A 5/1992 Hollander et al.
5,230,941 A 7/1993 Hollander et al.
5,237,838 A 8/1993 Merritt-Munson
5,269,149 A 12/1993 Zeidler
5,270,550 A 12/1993 Martorana et al.
5,314,087 A 5/1994 Shea
5,415,282 A * 5/1995 Kienholz ..... A61B 10/0096 206/524.4
5,417,082 A 5/1995 Foster et al.
5,419,152 A * 5/1995 Silber ..... B65D 81/3858 62/457.2
5,435,142 A 7/1995 Silber
5,450,977 A 9/1995 Moe
5,492,267 A 2/1996 Hollander et al.
5,501,338 A 3/1996 Preston
5,638,979 A 6/1997 Shea
5,647,226 A 7/1997 Scaringe et al.
5,669,233 A 9/1997 Cook et al.
5,671,611 A 9/1997 Quigley
5,709,307 A 1/1998 Rosado et al.
5,770,295 A 6/1998 Alderman
5,897,017 A 4/1999 Lantz
5,899,088 A 5/1999 Purdum
5,924,302 A 7/1999 Derifield
5,934,099 A 8/1999 Cook et al.
5,976,400 A 11/1999 Muffett et al.
5,979,693 A 11/1999 Bane, III
6,003,719 A 12/1999 Stewart, III
6,044,650 A 4/2000 Cook et al.
6,048,099 A 4/2000 Muffett et al.
6,055,825 A 5/2000 Choy
6,070,427 A 6/2000 Fine et al.
6,079,404 A 6/2000 Salyer
6,116,042 A 9/2000 Purdum
6,158,227 A 12/2000 Seeley
6,192,703 B1 2/2001 Salyer et al.
6,209,343 B1 4/2001 Owen
6,212,901 B1 4/2001 Pint et al.
6,223,551 B1 5/2001 Mitchell
6,244,458 B1 6/2001 Frysinger et al.
6,257,764 B1 7/2001 Lantz
6,260,360 B1 7/2001 Wheeler
6,349,559 B1 2/2002 Hasanovic
6,377,755 B1 4/2002 Chamberlain et al.
6,381,981 B1 5/2002 Yaddgo et al.
6,401,461 B1 6/2002 Harrison et al.
6,412,545 B1 7/2002 Buff et al.
6,482,332 B1 11/2002 Malach
6,505,479 B2 1/2003 Defelice et al.
6,513,703 B2 2/2003 Becker
6,513,974 B2 2/2003 Malone et al.
6,536,228 B1 * 3/2003 Hall ..... F25D 3/08 62/457.2
6,543,491 B1 4/2003 Chung
6,559,096 B1 5/2003 Smith et al.
6,584,797 B1 7/2003 Smith et al.
6,645,598 B2 11/2003 Alderman
6,652,771 B2 11/2003 Carn
6,666,032 B1 12/2003 Rickson et al.
6,668,577 B2 * 12/2003 Quenedey ..... B65D 81/3813 62/530
6,675,605 B2 1/2004 Douglas-Hamilton
6,688,132 B2 2/2004 Smith et al.
6,701,724 B2 3/2004 Smith et al.
6,718,776 B2 4/2004 Wessling et al.
6,751,963 B2 6/2004 Navedo et al.
6,773,425 B1 8/2004 Tamari
6,822,198 B2 11/2004 Rix
6,834,159 B1 12/2004 Schramm
6,858,068 B2 2/2005 Smith et al.
6,868,982 B2 3/2005 Gordon
6,875,486 B2 4/2005 Miller
6,841,209 B2 11/2005 Legare
6,968,711 B2 11/2005 Smith et al.
7,094,192 B2 8/2006 Schoenberger et al.

(56) References Cited

U.S. PATENT DOCUMENTS 7,140,768 B2 11/2006 Prabhakar
7,147,626 B2 12/2006 Goodman et al.
7,225,632 B2 6/2007 Derifield
7,229,677 B2 6/2007 Miller
7,240,513 B1 7/2007 Conforti
7,257,963 B2 8/2007 Mayer
7,266,949 B2 9/2007 Jeuch et al.
7,310,967 B2 12/2007 Aragon
7,318,535 B2 1/2008 Gano, III et al.
7,328,583 B2 2/2008 Hillman et al.
7,412,846 B2 8/2008 Sekiya et al.
7,422,143 B2 9/2008 Mayer
7,500,593 B2 3/2009 Mayer
7,516,600 B1 4/2009 Flora
7,641,812 B2 1/2010 Alderman
7,677,406 B2 3/2010 Maxson
7,682,654 B2 3/2010 Cooper et al.
7,704,584 B2 4/2010 Alderman
7,721,566 B1 5/2010 Wilken
7,784,301 B2 8/2010 Sasaki et al.
7,849,708 B2 12/2010 Goncharko et al.
7,905,075 B2 3/2011 Flora
7,908,870 B2 3/2011 Williams et al.
7,919,163 B2 4/2011 Romero
7,935,410 B2 5/2011 Orologio
7,950,246 B1 5/2011 Mayer et al.
7,975,905 B2 7/2011 Humphries et al.
8,056,357 B2 11/2011 Bruce
8,074,465 B2 12/2011 Heroux et al.
8,156,703 B2 4/2012 Alderman
8,250,882 B2 8/2012 Mustafa et al.
8,292,119 B2 10/2012 Kenneally
8,349,552 B2 1/2013 Haarmann et al.
8,424,335 B2 4/2013 Corder et al.
8,443,623 B2 5/2013 Matta et al.
8,539,790 B1 9/2013 Budd
8,541,094 B2 9/2013 Miller
8,600,903 B2 12/2013 Eller
8,603,598 B2 12/2013 Hyde et al.
8,607,581 B2 12/2013 Williams et al.
8,613,202 B2 12/2013 Williams
8,763,423 B2 7/2014 Tattam
8,763,811 B2 7/2014 Lantz
8,763,886 B2 7/2014 Hall
8,887,515 B2 11/2014 Patstone
8,904,810 B2 12/2014 Schabron et al.
8,938,986 B2 1/2015 Matta et al.
9,022,249 B2 5/2015 Ranade
9,045,278 B2 6/2015 Mustafa et al.
9,060,508 B2 6/2015 Anti et al.
9,066,613 B2 6/2015 Kelly
9,090,392 B2 7/2015 Loeschen et al.
9,132,604 B2 9/2015 Chalve
9,133,973 B2 9/2015 Smith
9,139,319 B2 9/2015 Crespo et al.
9,151,531 B2 10/2015 Wengreen et al.
9,180,998 B2 11/2015 Banks et al.
9,267,722 B2 2/2016 Blezard et al.
9,284,088 B2 3/2016 Humphries et al.
9,366,469 B2 6/2016 Chapman, Jr.
9,376,605 B2 6/2016 Matta et al.
9,429,350 B2 8/2016 Chapman, Jr.
9,556,373 B2 1/2017 Formato et al.
9,581,374 B2 2/2017 Kuhn et al.
9,598,622 B2 3/2017 Formato et al.
9,689,602 B2 6/2017 Emond et al.
9,707,156 B2 7/2017 Wengreen et al.
9,738,420 B2 8/2017 Miller
9,814,651 B2 11/2017 Wengreen et al.
9,877,894 B2 1/2018 Wengreen et al.
9,913,777 B2 3/2018 Wengreen et al.
9,944,449 B2 4/2018 Wood et al.
9,956,140 B2 5/2018 Wengreen et al.
9,957,099 B2 5/2018 White et al.
10,077,389 B2 9/2018 Formato et al.
10,309,709 B2 6/2019 Emond et al.
10,543,973 B2 * 1/2020 Cunningham ..... B65D 81/389
10,583,978 B2 3/2020 Longley et al.
10,604,326 B2 3/2020 Longley et al.
10,618,695 B2 4/2020 McCormick
10,661,969 B2 5/2020 Pranadi et al.
10,766,685 B2 9/2020 Kuhn et al.
10,829,675 B2 11/2020 Formato et al.
11,137,190 B2 * 10/2021 Martino ..... B65D 81/3862
11,340,005 B2 5/2022 Nilsen et al.
D966,101 S 10/2022 Blezard et al.
11,511,928 B2 * 11/2022 Rizzo ..... F25D 3/00
2002/0124588 A1 * 9/2002 Quenedey ..... F25D 3/125
62/371
2002/0147242 A1 10/2002 Salyer et al.
2002/0164474 A1 11/2002 Buckley
2003/0082357 A1 5/2003 Gokay et al.
2003/0102317 A1 6/2003 Gordon
2004/0231355 A1 * 11/2004 Mayer ..... C09K 5/063
62/457.2
2005/0118915 A1 6/2005 Heifetz
2005/0189404 A1 9/2005 Xiaohai et al.
2005/0224501 A1 10/2005 Folkert et al.
2007/0028642 A1 2/2007 Glade et al.
2007/0193297 A1 8/2007 Wilson
2007/0295733 A1 12/2007 Balva et al.
2008/0014435 A1 1/2008 Smith et al.
2008/0022696 A1 1/2008 Welle et al.
2008/0099492 A1 5/2008 Mayer
2008/0135564 A1 * 6/2008 Romero ..... B65D 81/3827
220/592.2
2008/0276643 A1 * 11/2008 Heroux ..... F25D 3/06
220/592.2
2009/0000312 A1 1/2009 Smith et al.
2009/0078699 A1 3/2009 Mustafa et al.
2009/0230139 A1 9/2009 Li
2010/0018978 A1 1/2010 Osborne
2010/0314397 A1 12/2010 Williams et al.
2011/0030415 A1 2/2011 Breyburg et al.
2011/0155621 A1 6/2011 Lindquist et al.
2011/0220633 A1 * 9/2011 Mak ..... F25D 3/08
219/482
2011/0248038 A1 10/2011 Mayer
2011/0290792 A1 12/2011 Krzak et al.
2012/0072046 A1 3/2012 Tattam
2012/0243808 A1 9/2012 de Lesseux et al.
2012/0279896 A1 11/2012 Lantz
2012/0318808 A1 12/2012 McCormick
2013/0055750 A1 3/2013 Mustafa et al.
2013/0062355 A1 3/2013 Shulman
2013/0213977 A1 * 8/2013 Stathes ..... B65D 81/3848
220/592.26
2013/0228583 A1 9/2013 Mayer
2013/0255306 A1 10/2013 Mayer
2014/0008042 A1 1/2014 Schryver et al.
2014/0054297 A1 2/2014 Patstone
2014/0130526 A1 5/2014 Kerkmans
2014/0151382 A1 6/2014 White et al.
2014/0174692 A1 6/2014 Emond et al.
2014/0196305 A1 7/2014 Smith
2014/0311170 A1 10/2014 Mills et al.
2014/0343493 A1 11/2014 Wengreen
2014/0345316 A1 11/2014 Godbole et al.
2014/0360044 A1 12/2014 Smith
2015/0068242 A1 3/2015 Patstone
2015/0158656 A1 6/2015 McKinnon
2015/0166244 A1 6/2015 Wood et al.
2015/0191291 A1 7/2015 Wood et al.
2015/0274415 A1 10/2015 Farrar et al.
2015/0285548 A1 10/2015 Emond et al.
2016/0243000 A1 8/2016 Gray
2016/0262979 A1 9/2016 Wengreen et al.
2016/0362240 A1 12/2016 Ferracamo, Jr.
2017/0082341 A1 * 3/2017 Shew ..... F25D 19/003
2017/0082344 A1 3/2017 Tansley
2017/0328822 A1 * 11/2017 Karbaschi ..... G01N 1/42
2018/0036202 A1 2/2018 Wengreen et al.
2018/0093816 A1 4/2018 Longley et al.
2018/0100682 A1 4/2018 Nilsen et al.

(56) References Cited

U.S. PATENT DOCUMENTS

| | | | | |
|---|---|---|---|---|
| 2018/0306482 | A1* | 10/2018 | Ball | F25D 25/021 |
| 2018/0320947 | A1 | 11/2018 | Jain et al. | |
| 2018/0328644 | A1 | 11/2018 | Rizzo et al. | |
| 2018/0353379 | A1* | 12/2018 | Chou | F25D 3/08 |
| 2019/0210790 | A1 | 7/2019 | Rizzo et al. | |
| 2019/0285328 | A1 | 9/2019 | Emond et al. | |
| 2020/0002075 | A1 | 1/2020 | Lee et al. | |
| 2020/0047993 | A1 | 2/2020 | Brabbs et al. | |
| 2020/0231362 | A1* | 7/2020 | Kulangara | B65D 81/3825 |
| 2020/0307896 | A1 | 10/2020 | Pranadi et al. | |
| 2020/0324959 | A1 | 10/2020 | Longley et al. | |
| 2020/0331686 | A1 | 10/2020 | Longley et al. | |
| 2020/0408453 | A1 | 12/2020 | Martino | |
| 2021/0024270 | A1 | 1/2021 | Mirzaee Kakhki | |
| 2021/0070539 | A1 | 3/2021 | Chasteen et al. | |
| 2021/0214599 | A1* | 7/2021 | Motonami | C09K 5/063 |
| 2021/0292630 | A1 | 9/2021 | Formato et al. | |
| 2021/0300665 | A1 | 9/2021 | Melchor | |
| 2021/0331834 | A1 | 10/2021 | Longley et al. | |
| 2022/0002070 | A1 | 1/2022 | Moghaddas et al. | |
| 2022/0265514 | A1 | 8/2022 | Blezard et al. | |
| 2022/0267081 | A1 | 8/2022 | Conway et al. | |
| 2022/0281671 | A1 | 9/2022 | Lee et al. | |
| 2022/0325938 | A1 | 10/2022 | Nilsen et al. | |

FOREIGN PATENT DOCUMENTS

| | | | |
|---|---|---|---|
| CA | 2824817 | A1 | 2/2015 |
| CN | 201457996 | U | 5/2010 |
| CN | 201581575 | U | 9/2010 |
| CN | 201721778 | U | 1/2011 |
| CN | 103640804 | A | 3/2014 |
| DE | 10148587 | C1 | 11/2002 |
| DE | 202011050514 | U8 | 3/2012 |
| EP | 0157751 | A2 | 10/1985 |
| EP | 750732 | B1 | 8/1999 |
| EP | 1006058 | A1 | 6/2000 |
| EP | 1336574 | A2 | 8/2003 |
| EP | 1110043 | B1 | 11/2004 |
| EP | 1780147 | A1 | 5/2007 |
| EP | 2374443 | B1 | 1/2014 |
| FR | 993538 | A | 11/1951 |
| FR | 1111645 | A1 | 3/1956 |
| FR | 2518504 | A1 | 6/1983 |
| FR | 2535691 | A1 | 5/1984 |
| FR | 2832133 | A1 | 5/2003 |
| FR | 2833074 | B1 | 1/2004 |
| FR | 2847237 | B1 | 8/2005 |
| FR | 2948342 | A1 | 1/2011 |
| GB | 908002 | A | 10/1962 |
| GB | 1338554 | A | 11/1973 |
| GB | 2336899 | A | 11/1999 |
| GB | 2383122 | A | 6/2003 |
| GB | 2383402 | A | 6/2003 |
| JP | 3271943 | B2 | 4/2002 |
| JP | 2006011585 | A | 1/2006 |
| JP | 2006232331 | A | 9/2006 |
| JP | 4225157 | B2 | 2/2009 |
| JP | 2009149380 | A | 7/2009 |
| JP | 4903831 | B2 | 3/2012 |
| KR | 200249267 | Y1 | 11/2001 |
| KR | 101519521 | B1 | 5/2015 |
| WO | 8702122 | A1 | 4/1987 |
| WO | 2003073030 | A1 | 9/2003 |
| WO | 2006012074 | A2 | 2/2006 |
| WO | 2006095038 | A2 | 9/2006 |
| WO | 2007042248 | A1 | 4/2007 |
| WO | 2011023996 | A2 | 3/2011 |
| WO | 2014100826 | A1 | 6/2014 |
| WO | 2015153607 | A1 | 10/2015 |
| WO | 2016177523 | A1 | 11/2016 |
| WO | 2017048793 | A1 | 3/2017 |
| WO | 2017072638 | A1 | 5/2017 |
| WO | 2018213348 | A2 | 11/2018 |
| WO | 2019241720 | A1 | 12/2019 |

OTHER PUBLICATIONS

Written Opinion dated Apr. 20, 2020 in corresponding PCT Application No. PCT/US2020/014154.

U.S. Appl. No. 16/246,435, inventors James Robert Chasteen et al., filed Jan. 11, 2019 (available in USPTO's IFW system).

Singh et al., "Performance Comparison of Thermal Insulated Packaging Boxes, Bags and Refrigerants for Single-parcel Shipments," Packaging Technology and Science 21: 25-35 (2008).

ElFantastic0, "Make a well-insulated travel cooler," instructables, instructables.com (2016). http://web.archive.org/web/20161019021006/http://www.instructables.com:80/id/Makeawellinsulatedtravelcooler/.

"Insulated Shipping Box Liners," Innovative Energy, Inc., insultote.net (2014). http://web.archive.org/web/20140709090405/http://www.insultote.net/insulatedboxliners.php.

"Lower-Impact Packaging and Shipping," Thermo Fisher Scientific, thermofisher.com (2016). https://webbeta.archive.org/web/20160710092816/http://www.thermofisher.com:80/us/en/home/aboutus/productstewardship/ambientshipping.html.

"Foil Bubble Insulating Bags Covers." Bee Packaging, beepacking.com (2017). https://www.beepackaging.com/foilbubble/.

"Reflective Solutions." KodiaKooler®, kodiakooler.com (2017). https://kodiakooler.com/products/kodiakoolerreflectiveproducts.

"InsulTote® Insulated Packaging Supplies," Inovative Energy, Inc., insultote.net, accessed: Feb. 2016. http://insultote.net/insulatedpackaging.php.

"Temperature Control Packaging," IPC, ipcpack.com, accessed: Feb. 2016. http://www.ipcpack.com/products/temperature-control-packaging/.

"Shipping Products," rFOIL™, rfoil.com, accessed: Feb. 2016. http://www.rfoil.com/products-sp.shtml.

"Temperature Packaging," Miller Supply, Inc., millersupplyinc.com, accessed: Feb. 2016. http://www.millersupplyinc.com/boxes/temperature-packaging-c-2_2898.html.

"Cool Blue™ Insulated Foil Bubble Box Liners (Box Inserts)," Nortech Labs, nortechlabs.com, accessed: Feb. 2016. http://www.nortechlabs.com/insulated-box-liners.html.

"Reflect-A-Cool—Heat Reflective Sheets," DEI Power Sports, deipowersports.com, 2014. https://www.deipowersports.com/products/thermal-barriers/reflect-a-cool.

Pack-out Sheet for KoolTemp GTS Extreme 45L, Frozen, Universal Packout, Cold Chain Technologies, Franklin, MA (2015).

Pack-out Sheet for KoolTemp GTS Extreme 45L, +2° C. to 8° C., Universal Packout, Cold Chain Technologies, Franklin, MA (2014).

Pack-out Sheet for KoolTemp GTS Excel 12L, +2° C. to 8° C., Universal Packout, Cold Chain Technologies, Franklin, MA (2013).

Pack-out Sheet for KoolTemp GTS Extreme 7L, +2° C. to 8° C., Universal Packout, Cold Chain Technologies, Franklin, MA (2014).

Pack-out Sheet for KoolTemp GTS Extreme 15L, +2° C. to 8° C., Universal Packout, Cold Chain Technologies, Franklin, MA (2014).

Pack-out Sheet for KoolTemp GTS Extreme 30L, +2° C. to 8° C., Universal Packout, Cold Chain Technologies, Franklin, MA (2014).

Pack-out Sheet for KoolTemp GTS Extreme 40L, +2° C. to 8° C., Universal Pack-out, Cold Chain Technologies, Franklin, MA (2015).

Formato, "The Advantages & Challenges of Phase Change Materials (PCMs) In Thermal Packaging," Cold Chain Technologies, coldchaintech.com,accessed: Jun. 2017.

"SavEnrg™ Temperature Controlled Packaging," SavEnrg™, rgees.com, accessed: Jun. 2017.

"Insulated Shipping Containers," NanoPore, nanopore.com, 2008. http://www.nanopore.com/shipping.html.

"Phase Change Materials: Temperature control for wine shipping containers," RGEES, LLC, phasechangematerials.blogspot.com, Jul. 13, 2012.http://phasechangematerials.blogspot.com/2012/07/temperature-control-for-wine-shipping.html.

Abstract of Shrivastava, Saurabh, and Bahgat Sammakia, "Thermal management of biomaterials in a rectangular cavity surrounded by a phase change material," Thermal and Thermomechanical Phenomena in Electronic Systems, 2004.ITHERM'04, The Ninth Intersociety Conference, vol. 1, IEEE, 2004.http://ieeexplore.ieee.org/document/1319162/.

(56) References Cited

OTHER PUBLICATIONS

"A eutectic mixture of galactitol and mannitol as a phase change material for latent heat storage" (sciencedirect.com) Oct. 2015 [online] retrieved from <URL:https://www.sciencedirect.com/science/article/abs/pii/S0196890415005531>.
U.S. Appl. No. 16/827,086, inventors Dawn E. Smith et al., filed Mar. 23, 2020 (available in USPTO's IFW system).
U.S. Appl. No. 17/687,382, inventors James R. Chasteen et al., filed Mar. 4, 2022 (available in USPTO's IFW system).
U.S. Appl. No. 17/726,318, inventors Henry Melchor et al., filed Apr. 21, 2022 (available in USPTO's IFW system).
U.S. Appl. No. 17/891,631, inventors Heather M. Conway et al., filed Aug. 19, 2022 (available in USPTO's IFW system).
U.S. Appl. No. 17/668,569, inventors William C. Blezard et al., filed Feb. 10, 2022 (available in USPTO's IFW system).

* cited by examiner

THERMALLY INSULATED SHIPPING SYSTEM FOR PARCEL-SIZED PAYLOAD

CROSS-REFERENCE TO RELATED APPLICATIONS

The present application claims the benefit under 35 U.S.C. 119(e) of U.S. Provisional Patent Application No. 62/793,560, inventors Jeena Kulangara et al., filed Jan. 17, 2019, the disclosure of which is incorporated herein by reference in its entirety.

BACKGROUND OF THE INVENTION

The present invention relates generally to thermally insulated shipping systems and relates more particularly to thermally insulated shipping systems of the type that may be used to transport parcel-sized payloads.

Thermally insulated shipping systems of the type that may be used to transport parcel-sized payloads of temperature-sensitive materials, such as biological and/or pharmaceutical products, are well-known.

An illustrative example of a thermally insulated shipping system that may be used to transport parcel-sized payloads is discussed below. More specifically, in U.S. Pat. No. 9,045,278, inventors Mustafa et al., which issued Jun. 2, 2015, and which is incorporated herein by reference, there is disclosed an insulated shipping container and method of making the same. In a preferred embodiment, the insulated shipping container includes an outer box, an insulated insert, an insulated cover, a payload container and a plurality of coolant members. The insulated insert is snugly, but removably, disposed within the outer box and is shaped to include a plurality of sides and a top. The top includes a raised peripheral edge and a recessed shelf. A large rectangular prismatic cavity surrounded by a plurality of smaller cavities extends downwardly from the recessed shelf. The large cavity of the insulated insert is adapted to receive a payload container. Each of the smaller cavities of the insulated insert has a "top hat" shape when viewed from above that includes a crown portion and a brim portion.

As can be appreciated, a system of the type described above is somewhat bulky and is not well-suited to be shipped in a standard-size courier box, such as a FedEx® Box—Large or a UPS® Large Express Box. Such standard-size courier boxes, which are typically made of coated or uncoated corrugated cardboard or the like, typically have dimensions of approximately 18 inches×13 inches×3 inches.

Accordingly, there is a need for a thermally insulated shipping system that is capable of being used in conjunction with standard-size courier boxes, such as a FedEx® Box—Large or a UPS® Large Express Box.

Documents that may be of interest to the present invention may include the following, all of which are incorporated herein by reference: U.S. Pat. No. 10,309,709 B2, inventors Emond et al., which issued Jun. 4, 2019; U.S. Pat. No. 9,689,602 B2, inventors Emond et al., which issued Jun. 27, 2017; U.S. Pat. No. 8,074,465 B2, inventors Heroux et al., which issued Dec. 13, 2011; U.S. Pat. No. 7,422,143 B2, inventor Mayer, which issued Sep. 9, 2008; U.S. Pat. No. 7,257,963 B2, inventor Mayer, which issued Aug. 21, 2007; U.S. Pat. No. 7,240,513 B1, inventor Conforti, which issued Jul. 10, 2007; U.S. Pat. No. 6,875,486 B2, inventor Miller, which issued Apr. 5, 2005; U.S. Pat. No. 6,482,332 B1, inventor Malach, which issued Nov. 19, 2002; U.S. Pat. No. 6,116,042, inventor Purdum, which issued Sep. 12, 2000; U.S. Pat. No. 5,899,088, inventor Purdum, which issued May 4, 1999; U.S. Pat. No. 4,145,895, inventors Hjertstrand et al., which issued Mar. 27, 1979; U.S. Patent Application Publication No. US 2020/0002075 A1, inventors TzeHo Lee et al., which published Jan. 2, 2020; U.S. Patent Application Publication No. US 2019/0210790 A1, inventors Anthony Rizzo et al., which published Jul. 11, 2019; and PCT International Publication No. WO 2019/241720 A1, published Dec. 19, 2019.

SUMMARY OF THE INVENTION

It is an object of the present invention to provide a novel thermally insulated shipping system that may be used to transport a parcel-sized payload.

According to one aspect of the invention, there is provided a shipping system for a payload, the shipping system comprising: (a) an insulated container, wherein the insulated container includes a bottom wall comprising insulation, a top wall comprising insulation, and a cavity between the bottom wall and the top wall, wherein the cavity includes a length, a width, and a height, and wherein each of the length and the width is greater than the height; (b) a first thermally conductive layer, the first thermally conductive layer disposed on one of a top surface of the bottom wall and a bottom surface of the top wall; (c) a payload box for holding the payload, the payload box disposed within the cavity and in direct contact with the first thermally conductive layer; and (d) a first temperature-control member, the first temperature-control member comprising a phase-change material, wherein the first temperature-control member is disposed within the cavity and is in direct contact with the first thermally conductive layer.

In a more detailed feature of the invention, the shipping system may be devoid of phase-change material above the payload box and below the payload box.

In a more detailed feature of the invention, the bottom wall may be part of a base, and the base may further comprise a plurality of side walls extending upwardly from the bottom wall.

In a more detailed feature of the invention, the top wall may be seated on top of the side walls of the base.

In a more detailed feature of the invention, at least some of the side walls may comprise protrusions extending into the cavity.

In a more detailed feature of the invention, the first thermally conductive layer may be disposed on the top surface of the bottom wall.

In a more detailed feature of the invention, the first thermally conductive layer may be disposed on the bottom surface of the top wall.

In a more detailed feature of the invention, the shipping system may further comprise a second thermally conductive layer, the first thermally conductive layer may be disposed on the top surface of the bottom wall, and the second thermally conductive layer may be disposed on the bottom surface of the top wall.

In a more detailed feature of the invention, the insulated container may further comprise an outer box, and the bottom wall and the top wall may be disposed within the outer box.

In a more detailed feature of the invention, the insulated container may further comprise at least one side wall comprising insulation, and the at least one side wall may interconnect the bottom wall and the top wall.

In a more detailed feature of the invention, the insulated container may be devoid of a side wall comprising insulation interconnecting the bottom wall and the top wall.

In a more detailed feature of the invention, the payload box may have a length, a width, and a height, and the length of the payload box and the width of the payload box may be greater than the height of the payload box.

In a more detailed feature of the invention, the shipping system may further comprise a second temperature-control member, the second temperature-control member may comprise a phase-change material, and the second temperature-control member may be disposed within the cavity and may be in direct contact with the first thermally conductive layer.

In a more detailed feature of the invention, the first temperature-control member and the second temperature-control member may be preconditioned at different preconditioning temperatures.

In a more detailed feature of the invention, the shipping system may further comprise an insulation member positioned between the first temperature-control member and the payload box.

In a more detailed feature of the invention, the insulation member may comprise an insulation frame, and the insulation frame may be shaped to surround the payload box while having an open top and an open bottom.

In a more detailed feature of the invention, the top surface of the bottom wall, the bottom surface of the top wall, and the first thermally conductive layer may have matching footprints.

In a more detailed feature of the invention, the first thermally conductive layer may comprise at least one transverse opening.

In a more detailed feature of the invention, the first thermally conductive layer may have a footprint that may be less than that of the top surface of the bottom wall and that may be less than that of the bottom surface of the top wall and that may be closer to but greater than that of the payload box.

In a more detailed feature of the invention, the first thermally conductive member may be permanently coupled to the insulated container.

In a more detailed feature of the invention, the first thermally conductive member may be removably coupled to the insulated container.

According to another aspect of the invention, there is provided a kit for use in assembling a shipping system for a payload, the kit comprising: (a) a bottom wall, the bottom wall comprising insulation; (b) a top wall, the top wall comprising insulation, the top wall being adapted to be positioned relative to the bottom wall so as to define a cavity therebetween; (c) a first thermally conductive layer, the first thermally conductive layer being adapted to be removably mounted on a top surface of the bottom wall; (d) a second thermally conductive layer, the second thermally conductive layer being adapted to be removably mounted on a bottom surface of the top wall; (e) a payload box adapted for holding the payload, the payload box being adapted to be disposed within the cavity and being adapted for contact with at least one of the first and second thermally conductive layers; and (f) at least one temperature-control member comprising a phase-change material, the at least one temperature-control member being adapted to be disposed within the cavity and being adapted for contact with at least one of the first and second thermally conductive layers; (g) wherein the kit is capable of being assembled into a plurality of alternative shipping system configurations, wherein a first alternative shipping system configuration comprises the bottom wall, the top wall, the first thermally conductive layer, the second thermally conductive layer, and the at least one temperature-control member, wherein a second alternative shipping system configuration comprises the bottom wall, the top wall, the at least one temperature-control member, and only one of the first thermally conductive layer and the second thermally conductive layer, and wherein a third alternative shipping system configuration comprises the bottom wall, the top wall, and the at least one temperature-control member, with both the first thermally conductive layer and the second thermally conductive layer being omitted.

In a more detailed feature of the invention, the bottom wall may be formed as part of a base, and the base may further comprise a plurality of side walls extending upwardly from the bottom wall.

In a more detailed feature of the invention, the at least one temperature-control member may comprise a plurality of temperature-control members.

In a more detailed feature of the invention, the kit may further comprise an insulation frame adapted to receive the payload box so as to keep the at least one temperature-control member from directly contacting the payload box.

In a more detailed feature of the invention, the cavity may include a length, a width, and a height, and each of the length and the width may be greater than the height.

In a more detailed feature of the invention, in each of the alternative shipping system configurations, the shipping system may be devoid of phase-change material above the payload box and below the payload box.

According to another aspect of the invention, there is provided a method of preparing a payload for shipping, the method comprising the steps of: (a) providing the kit described above; (b) preconditioning the at least one temperature-control member; (c) loading the payload into the payload box; and (d) assembling the kit to form one of the first, second, and third alternative shipping configurations, wherein, if the payload is to be shipped over a route in which the mean ambient temperature is expected to be in excess of a first temperature, the first alternative shipping system configuration is assembled, wherein, if the payload is to be shipped over a route in which the mean ambient temperature is expected to be below a second temperature, the second temperature being lower than the first temperature, the third alternative shipping system configuration is assembled, and wherein, if the payload is to be shipped over a route in which the mean ambient temperature is expected to be greater than or equal to the second temperature and less than or equal to the first temperature, the second alternative shipping system configuration is assembled.

In a more detailed feature of the invention, the first temperature may be 25° C., and the second temperature may be 10° C.

According to another aspect of the invention, there is provided a method of shipping a plurality of payloads, the method comprising the steps of: (a) providing the kit described above; (b) preconditioning the at least one temperature-control member; (c) loading a first payload into the payload box; (d) then, assembling the kit to form one of the first, second, and third alternative shipping configurations, wherein, if the first payload is to be shipped over a route in which the mean ambient temperature is expected to be in excess of a first temperature, the first alternative shipping system configuration is assembled, wherein, if the first payload is to be shipped over a route in which the mean ambient temperature is expected to be below a second temperature, wherein the second temperature is below the first temperature, the third alternative shipping system configuration is assembled, and wherein, if the first payload is to be shipped over a route in which the mean ambient temperature is expected to be greater than or equal to the second temperature and less than or equal to the first temperature, the second alternative shipping system configuration is assembled; (e) then, shipping the first payload using the assembled shipping system configuration; (f) then, removing the first payload from the payload box; and (g) repeating steps (b) through (f) for a second payload.

In a more detailed feature of the invention, the first temperature may be 25° C., and the second temperature may be 10° C.

Additional objects, as well as aspects, features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. These drawings are not necessarily drawn to scale, and certain components may have undersized and/or oversized dimensions for purposes of explication. In the drawings wherein like reference numeral represent like parts:

FIG. 2(*b*) is a top view of the thermally insulated shipping system of FIG. 2(*a*), with the top thermally conductive member removed;

FIG. 2(*c*) is a top view of the thermally insulated shipping system of FIG. 2(*b*), with the temperature-control members removed;

FIG. 2(*d*) is a top view of the thermally insulated shipping system of FIG. 2(*c*), with the payload box removed;

FIG. 8(*b*) is a top view of the thermally insulated shipping system of FIG. 8(*a*), with the top thermally conductive member removed;

FIG. 8(*c*) is a top view of the thermally insulated shipping system of FIG. 8(*b*), with the temperature-control members removed;

FIG. 8(*d*) is a top view of the thermally insulated shipping system of FIG. 8(*c*), with the payload box removed;

FIG. 11(*b*) is a top view of the thermally insulated shipping system of FIG. 11(*a*), with the top thermally conductive member removed;

FIG. 11(*c*) is a top view of the thermally insulated shipping system of FIG. 11(*b*), with the temperature-control members removed;

FIG. 11(*d*) is a top view of the thermally insulated shipping system of FIG. 11(*c*), with the payload box removed;

DETAILED DESCRIPTION OF THE INVENTION

Figure 1A:
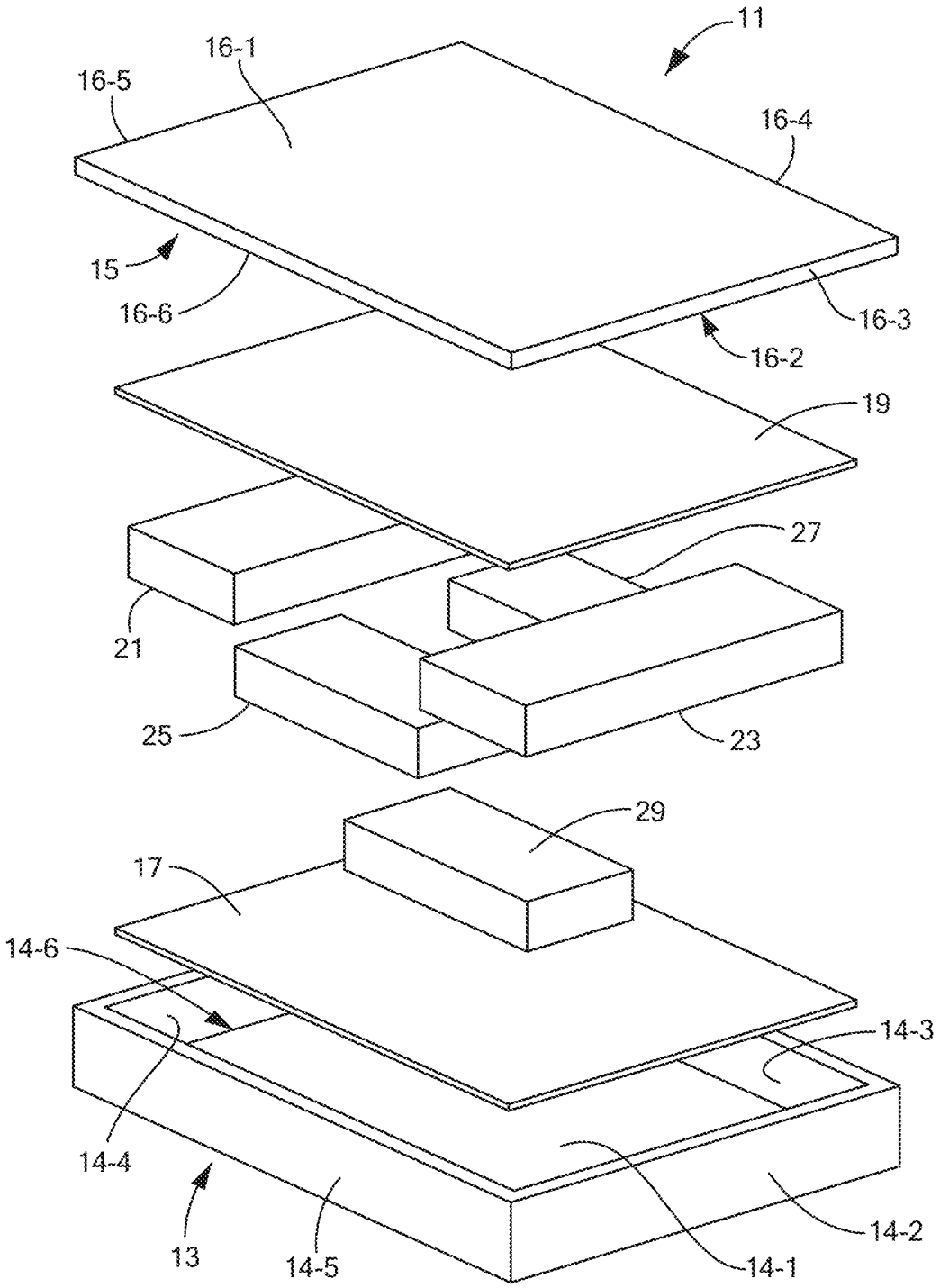
FIGS. 1(*a*) and 1(*b*) are exploded perspective and simplified section views, respectively, of a first embodiment of a thermally insulated shipping system that may be used to transport a parcel-sized payload, the thermally insulated shipping system being constructed according to the teachings of the present invention.

The present invention is directed at a shipping system that may be used to maintain a temperature-sensitive payload within a desired temperature range for a particular period of time. The system may be used with a parcel-sized payload and is particularly well-suited for use with standard-size courier boxes, such as a FedEx® Box—Large or a UPS® Large Express Box.

In some embodiments, the shipping system may be characterized by having a low-profile shape. In other words, the overall dimensions of the shipping system may be such that the height of the shipping system may be less than both the length of the shipping system and the width of the shipping system. Such a low-profile shape, which may correspond to that of certain standard-size courier boxes, such as a FedEx® Box—Large or a UPS® Large Express Box, may enable the shipping system to be received (and, if appropriately sized, snugly received) within such courier boxes.

In some embodiments, the shipping system may also be characterized by comprising a payload box that has a low-profile shape (i.e., a height that is less than both its length and its width).

In some embodiments, the shipping system may also be further characterized by comprising at least one thermally conductive layer. In some embodiments, the at least one thermally conductive layer may comprise a single thermally conductive member positioned over the payload box or a single thermally conductive member positioned under the payload box. In some embodiments, the at least one thermally conductive layer may comprise a first thermally conductive member positioned over the payload box and a second thermally conductive member positioned under the payload box. In some embodiments, the at least one thermally conductive layer may include discontinuities, such as transverse openings, that may be used to lessen or, otherwise, to modify the "heat-spreading" effects of the at least one thermally conductive layer.

In some embodiments, the shipping system may comprise at least one temperature-control member comprising a phase-change material. In some embodiments, the shipping system may comprise a plurality of temperature-control members, each comprising a phase-change material. In some embodiments, the plurality of temperature-control members may be positioned in direct contact with one or more of the sides of the payload box and in direct contract with any thermally conductive layers; alternatively, in some embodiments, the temperature-control members may be separated from the one or more sides of the payload box by thermal insulation. In some embodiments, the shipping system is devoid of any temperature-control members positioned either above or below the payload box.

In some embodiments, the shipping system may be adaptable or configurable for use in different types of ambient environments (e.g., a high temperature range, a moderate temperature range, and a low temperature range) by the selective placement or removal of an upper thermal conductive layer and/or a lower thermal conductive layer.

Figure 1B:
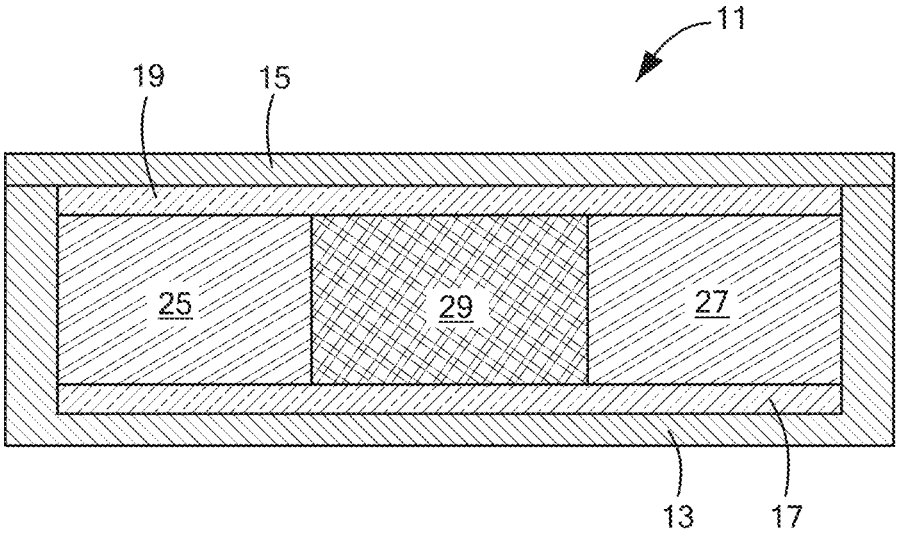
Figure 2A:
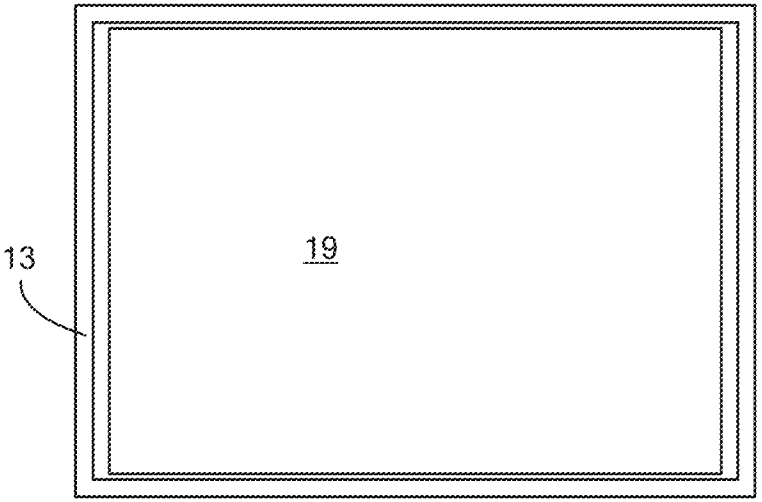
FIG. 2(*a*) is a top view of the thermally insulated shipping system of FIG. 1(*a*), with the thermally insulating lid removed.
Figure 2B:
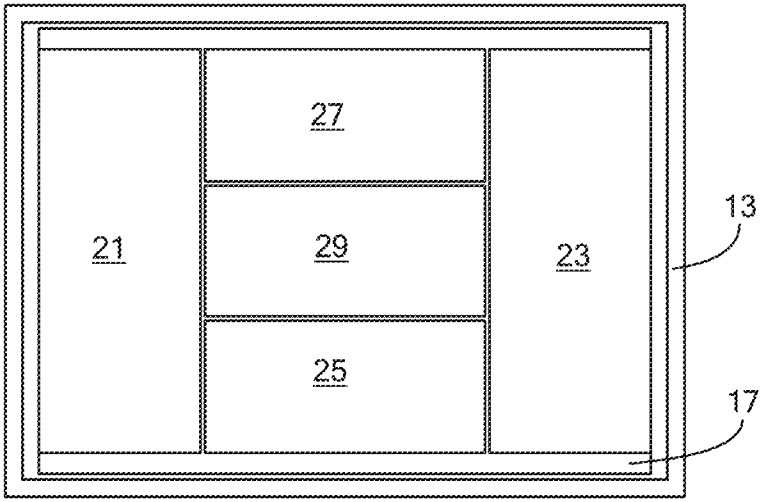
Figure 2C:
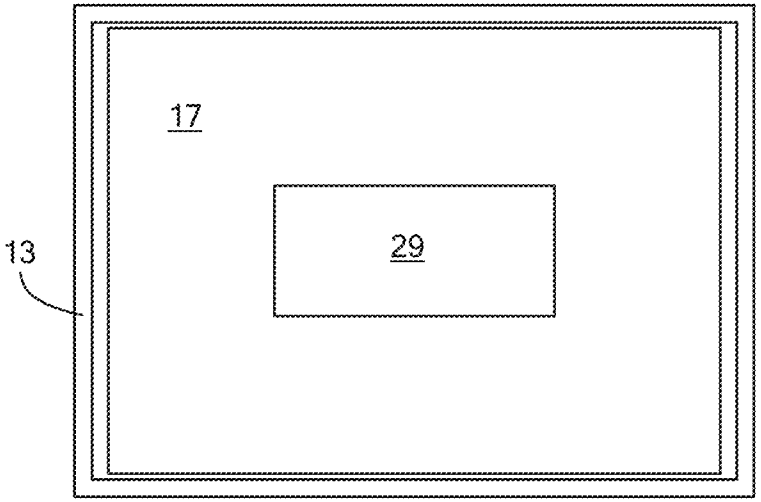
Figure 2D:
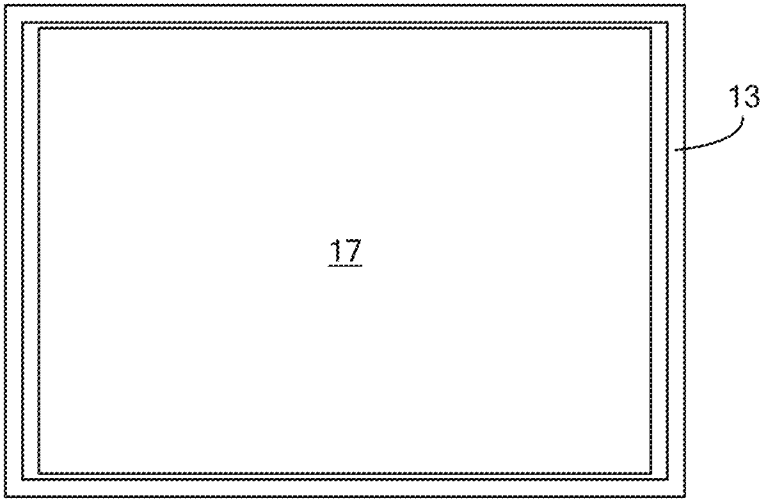

Referring now to FIGS. 1(*a*), 1(*b*), 2(*a*), 2(*b*), 2(*c*), and 2(*d*), there are shown various views of a first embodiment of a thermally insulated shipping system that may be used to transport a parcel-sized payload, the thermally insulated shipping system being constructed according to the present invention and being represented generally by reference numeral 11. Details of system 11 that are discussed elsewhere in this application or that are not critical to an understanding of the invention may be omitted from one or more of FIGS. 1(*a*), 1(*b*), 2(*a*), 2(*b*), 2(*c*), and 2(*d*) or from the accompanying description herein or may be shown in one or more of FIGS. 1(*a*), 1(*b*), 2(*a*), 2(*b*), 2(*c*), and 2(*d*) and/or described herein in a simplified manner.

System 11 may comprise a thermally insulating base 13, a thermally insulating lid 15, a bottom thermally conductive layer or member 17, a top thermally conductive layer or member 19, two large temperature-control members 21 and 23, two small temperature-control members 25 and 27, and a payload box 29.

Base 13 may be shaped to include a bottom wall 14-1, four side walls 14-2 through 14-5, and an open top. Bottom wall 14-1 and side walls 14-2 through 14-5 may collectively define a cavity 14-6, which may have a generally rectangular prismatic shape. Cavity 14-6 may be appropriately dimensioned to snugly receive thermally conductive bottom member 17, thermally conductive top member 19, large temperature-control members 21 and 23, small temperature-control members 25 and 27, and payload box 29.

Base 13 may consist of or may comprise a suitable thermally insulating material and may be formed as a unitary structure. Examples of materials that may be suitable for use in forming base 13 may include, but are not limited to, one or more of an expanded polystyrene, a polyurethane foam, and one or more vacuum insulated panels.

Lid 15, which may be in the form of a unitary block of generally rectangular prismatic shape comprising a top 16-1, a bottom 16-2 and four sides 16-3 through 16-6, may be dimensioned to sit atop the four side walls 14-2 through 14-5 of base 13 and may serve to close cavity 14-6. Lid 15 may be dimensioned so that its four sides 16-3 through 16-6 are substantially flush with side walls 14-2 through 14-5 of base 13. Lid 15 may consist of or may comprise a suitable thermally insulating material and may be made of the same material as base 13. For example, lid 15 may consist of or may comprise, but is not limited to, one or more of an expanded polystyrene, a polyurethane foam, and one or more vacuum insulated panels.

Although not shown in the present embodiment, lid 15 and base 13 may be formed with mating elements, such as corresponding tongue and groove elements, to promote the coupling of lid 15 to base 13. Alternatively, lid 15 may be hingedly coupled to base 13. If desired, closure elements (not shown), such as adhesive tape or mechanical fasteners, may be used to maintain lid 15 on base 13 in a closed state. Lid 15 and base 13 may form an airtight seal therebetween but need not do so.

Bottom thermally conductive member 17 may consist of or may comprise a thermally conductive material and may serve as a "heat-spreader" to promote the uniform distribution of the effects of temperature-control members 21, 23, 25, and 27 to payload box 29. Examples of materials suitable for use as bottom thermally conductive member 17 may include, but are not limited to, one or more of a metal foil, such as an aluminum foil, a metal mesh or screen, and a metal coating. Instead of a metal, the foil, mesh, screen, or coating may be made of a thermally conductive non-metal, such as carbon. Bottom thermally conductive member 17 may be disposed on the top surface of bottom wall 14-2 of base 13 and may be removably or fixedly mounted thereon. For example, where bottom thermally conductive member 17 is a metal foil, the metal foil may be removably or permanently coupled to the top surface of bottom wall 14-2 of base 13 by suitable adhesive means. As another example, where bottom thermally conductive member 17 is a metallic coating or is a non-metallic, thermally-conductive coating, such a coating may be applied to the top surface of bottom wall 14-2 of base 13, for example, by dip-coating, spray-coating or other suitable means.

In another embodiment (not shown), base 13 and bottom thermally conductive member 17 may form a composite structure of the type shown in U.S. Patent Application Publication No. US 2020/0002075 A1, inventors TzeHo Lee et al., which published Jan. 2, 2020, and which is incorporated herein by reference. More specifically, in such an embodiment, base 13 may comprise a body of foamed polyurethane that is at least partially encapsulated within an unfoamed polymer bag, and bottom thermally conductive member 17 may be positioned within the unfoamed polymer bag against the body of foamed polyurethane.

Top thermally conductive member 19 may consist of or may comprise a thermally conductive material and may serve as a "heat-spreader" to promote the uniform distribution of the effects of temperature-control members 21, 23, 25, and 27 to payload box 29. Examples of materials suitable for use as top thermally conductive member 19 may include, but are not limited to, one or more of a metal foil, such as an aluminum foil, a metal mesh or screen, and a metal coating. Instead of a metal, the foil, mesh, screen, or coating may be made of a thermally conductive non-metal, such as carbon. Top thermally conductive member 19 may be disposed on the bottom surface of lid 15 and may be removably or fixedly mounted thereon. For example, where top thermally conductive member 19 is a metal foil, the metal foil may be removably or permanently coupled to the bottom surface of lid 15 by suitable adhesive means. As another example, where top thermally conductive member 19 is a metallic coating or is a non-metallic, thermally-conductive coating, such a coating may be applied to the bottom surface of lid 15, for example, by dip-coating, spray-coating or other suitable means.

In another embodiment (not shown), lid 15 and top thermally conductive member 19 may form a composite structure of the type shown in U.S. Patent Application Publication No. US 2020/0002075 A1, inventors TzeHo Lee et al., which published Jan. 2, 2020, and which is incorporated herein by reference. More specifically, in such an embodiment, lid 15 may comprise a body of foamed polyurethane that is at least partially encapsulated within an unfoamed polymer bag, and top thermally conductive member 19 may be positioned within the unfoamed polymer bag against the body of foamed polyurethane.

Bottom thermally conductive member 17 and top thermally conductive member 19 may be identical to one another but need not be.

Each of temperature-control members 21, 23, 25, and 27 may comprise a quantity of a phase-change material encased within a suitable container. Temperature-control members 21, 23, 25, and 27 may be generally equal to one another in thickness and may have an appropriate thickness so that their respective bottom surfaces are in contact with bottom thermally conductive member 17 and so that their respective top surfaces are in contact with top thermally conductive member 19. Temperature-control members 21, 23, 25, and 27 may be dimensioned and arranged so that temperature-control members 21 and 23, which may be comparatively longer, are positioned parallel to the width of cavity 14-6 and so that temperature-control members 25 and 27, which may be comparatively shorter, are positioned parallel to the length of cavity 14-6. Temperature-control member 21 may abut one end of each of temperature-control members 25 and 27, and temperature-control member 23 may abut the opposite end of each of temperature-control members 25 and 27. Temperature-control members 21, 23, 25, and 27 may be arranged so that each is in contact with payload box 29.

In the present embodiment, each of temperature-control members 21, 23, 25, and 27 may comprise a refrigerant "brick," i.e., a foam block impregnated with water and encased within a polymer or foil casing. When used to keep the payload within a temperature range of +2° C. to +8° C., each of temperature-control members 21, 23, 25, and 27 may be in a frozen state, for example, by having been previously preconditioned at a freezing temperature (e.g., −20° C.); however, it is to be understood that some or all of temperature-control members 21, 23, 25, and 27 need not initially be in a frozen state when in use. For example, some of temperature-control members 21, 23, 25, and 27 may be appropriately preconditioned so as to be in a frozen state when initially used whereas others of temperature-control members 21, 23, 25, and 27 may be appropriately preconditioned at a refrigerated temperature (e.g., +5° C.) so as to be in a liquid state when initially used. Alternatively, if desired, all of the temperature-control members 21, 23, 25, and 27 may be preconditioned so as to be in a liquid state when initially used.

In addition, although, in the present embodiment, each of temperature-control members 21, 23, 25, and 27 is in the form of a brick, some or all of temperature-control members 21, 23, 25, and 27 need not be in the form of a brick. For example, some or all of temperature-control members 21, 23, 25 and 27 may be in the form of a gel pack. Such a gel pack may comprise, for example, a flexible pouch containing a mixture of water and a thickener (e.g., a polysaccharide thickener) to produce a gelled water mixture, or a water/salt solution with an optional thickener. Alternatively, the gel pack may comprise, for example, a flexible pouch containing a gelled organic phase-change material, such as is disclosed in U.S. Pat. No. 9,598,622 B2, inventors Formato et al., issued Mar. 21, 2017, and U.S. Patent Application Publication No. US 2018/0093816 A1, inventors Longley et al., published Apr. 5, 2018, both of which are incorporated herein by reference. More specifically, a suitable gelled organic phase-change material may comprise one or more n-alkanes, such as n-tetradecane (C14), n-pentadecane (C15), n-hexadecane (C16), n-heptadecane (C17), n-octadecane (C18), or combinations thereof, together with a gelling agent in the form of a styrene-ethylene-butylene-styrene triblock copolymer and/or a styrene-ethylene-propylene-styrene triblock copolymer.

It is to be understood that, although, in the present embodiment, each of temperature-control members 21, 23, 25, and 27 utilizes the same phase-change material (i.e., water), some or all of members 21, 23, 25, and 27 may comprise different phase-change materials from one another. In some embodiments, some of members 21, 23, 25, and 27 may be replaced with a "dummy" member lacking a phase-change material. Moreover, for payloads designed to be kept within temperature ranges other than +2° C. to +8° C., other phase-change materials and/or preconditioning temperatures may be used. This applies to all of the embodiments disclosed herein.

Payload box 29, which may be used to receive and to hold the payload, may consist of or comprise a corrugated cardboard or similar material. Payload box 29 may be appropriately dimensioned so that its top and bottom surfaces are in contact with top thermally conductive member 19 and bottom thermally conductive member 17, respectively.

Without wishing to be limited to any particular dimensions, system 11 may be constructed with the following dimensions: Base 13 may have inner dimensions of 16"×11"×1⅞", with a bottom wall and side wall thickness of 0.5". Lid 15 may have dimensions of 17"×12"×0.5". Each of bottom thermally conductive member 17 and top thermally conductive member 19 may be an aluminum foil having dimensions of 15.75"×10.75"×10 mil. Each of temperature-control members 21 and 23 may have dimensions of 107/8"×3.5"×1.5" and a mass of approximately 928 g. Each of temperature-control members 25 and 27 may have dimensions of 6⁵⁄₁₆"×3⅝"×1.5" and a mass of approximately 595 g. Payload box 29 may have outer dimensions of 7.5"×3.5"×1.5".

Figure 3:
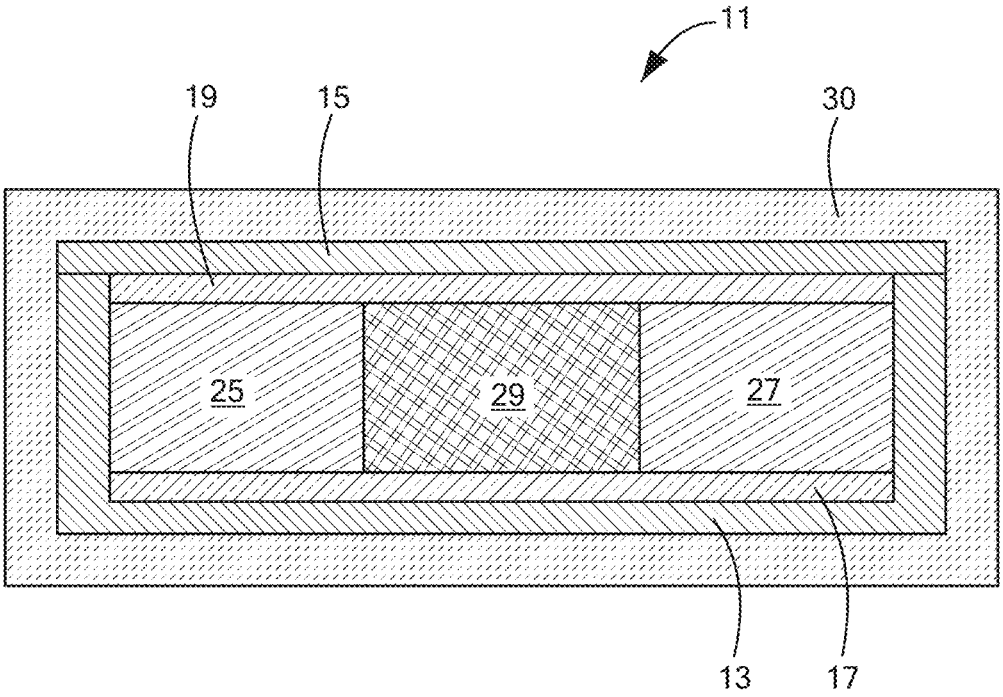
FIG. 3 is a simplified section view of the thermally insulated shipping system of FIG. 1(*b*), shown including a standard-size courier box.

It is to be understood that, although a box or container within which system 11 may be disposed (such as a FedEx® Box—Large or a UPS® Large Express Box) is not shown in FIGS. 1(*a*), 1(*b*), 2(*a*), 2(*b*), 2(*c*), and 2(*d*), as a component of system 11, such a box or container may be included as a component of system 11 (see FIG. 3, which includes box 30).

Also, it is to be understood that various modifications may be made to system 11. For example, one or both of bottom thermally conductive member 17 and top thermally conductive member 19 may be omitted and/or some of temperature-control members 21, 23, 25, and 27 may be preconditioned at different temperatures than others. Illustrative examples of the above are described below.

Figure 4:
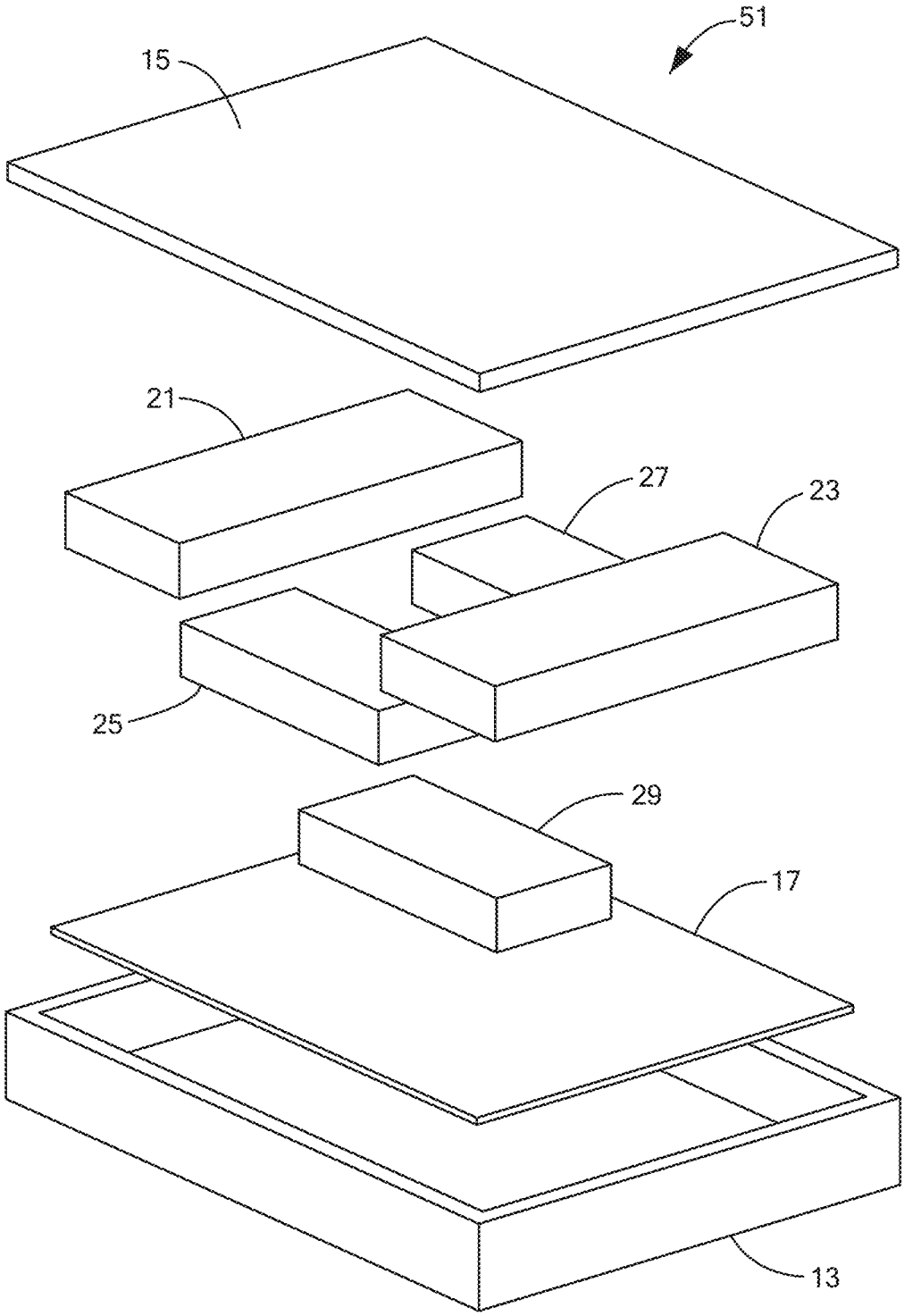
FIG. 4 is an exploded perspective view of a second embodiment of a thermally insulated shipping system that may be used to transport a parcel-sized payload, the thermally insulated shipping system being constructed according to the teachings of the present invention.

Referring now to FIG. 4, there is shown an exploded perspective view of a second embodiment of a thermally insulated shipping system that may be used to transport a parcel-sized payload, the thermally insulated shipping system being constructed according to the present invention and being represented generally by reference numeral 51. Details of system 51 that are discussed elsewhere in this application or that are not critical to an understanding of the invention may be omitted from FIG. 4 or from the accompanying description herein or may be shown in FIG. 4 and/or described herein in a simplified manner.

System 51 is similar in most respects to system 11, the principal difference between the two systems being that system 51 may omit top thermally conductive member 19 of system 11.

Figure 5:
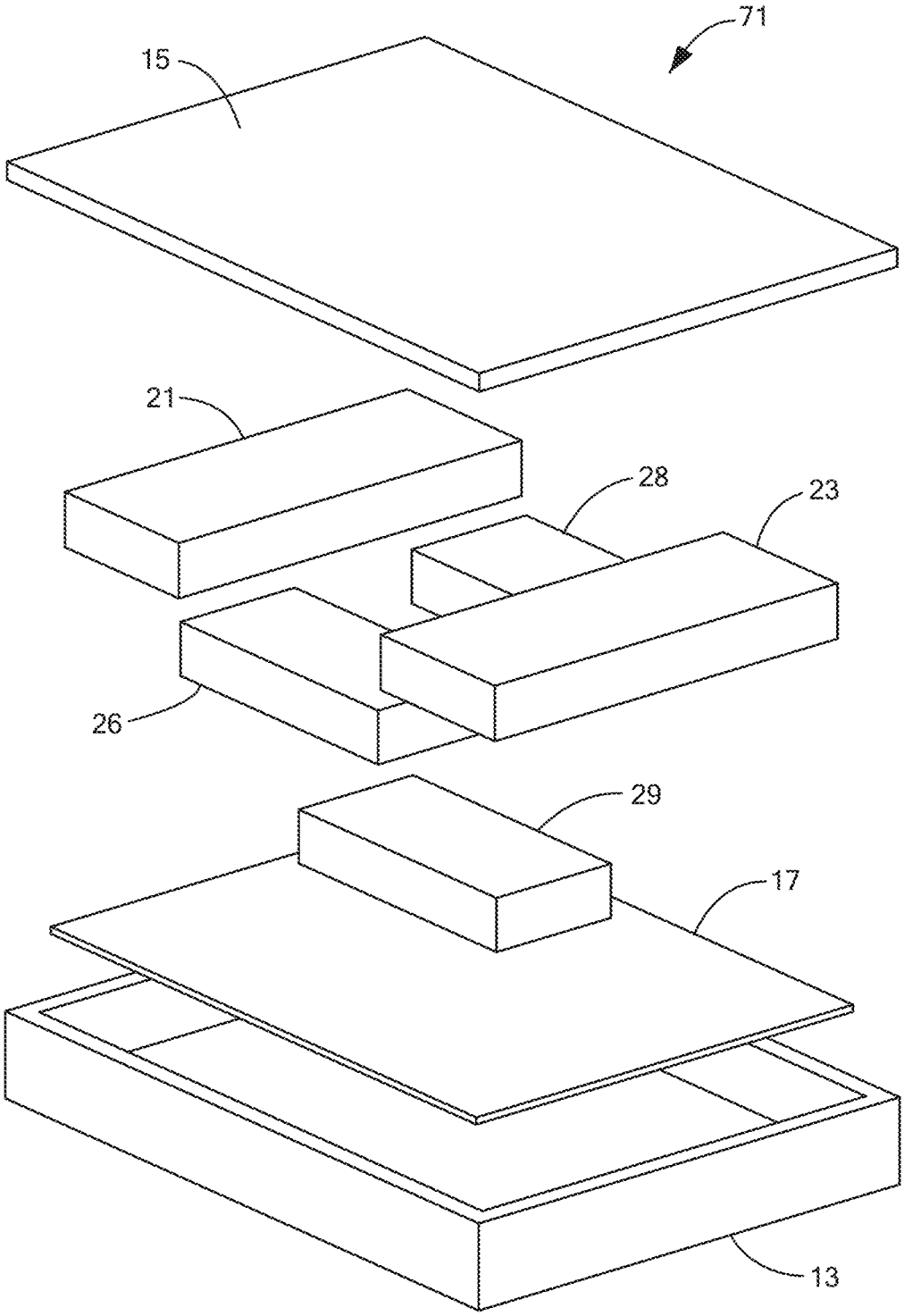
FIG. 5 is an exploded perspective view of a third embodiment of a thermally insulated shipping system that may be used to transport a parcel-sized payload, the thermally insulated shipping system being constructed according to the teachings of the present invention.

Referring now to FIG. 5, there is shown an exploded perspective view of a third embodiment of a thermally insulated shipping system that may be used to transport a parcel-sized payload, the thermally insulated shipping system being constructed according to the present invention and being represented generally by reference numeral 71. Details of system 71 that are discussed elsewhere in this application or that are not critical to an understanding of the invention may be omitted from FIG. 5 or from the accompanying description herein or may be shown in FIG. 5 and/or described herein in a simplified manner.

System 71 is similar in most respects to system 51, the principal difference between the two systems being that, in system 71, temperature-control members 21 and 23 are preconditioned at −20° C. and, thus, are in a frozen state whereas temperature-control members 26 and 28 (which are similar to temperature-control members 25 and 27 of system 51, except that they are preconditioned at a different preconditioning temperature) are preconditioned at +5° C. and, thus, are in a liquid state (i.e., refrigerated).

Figure 6:
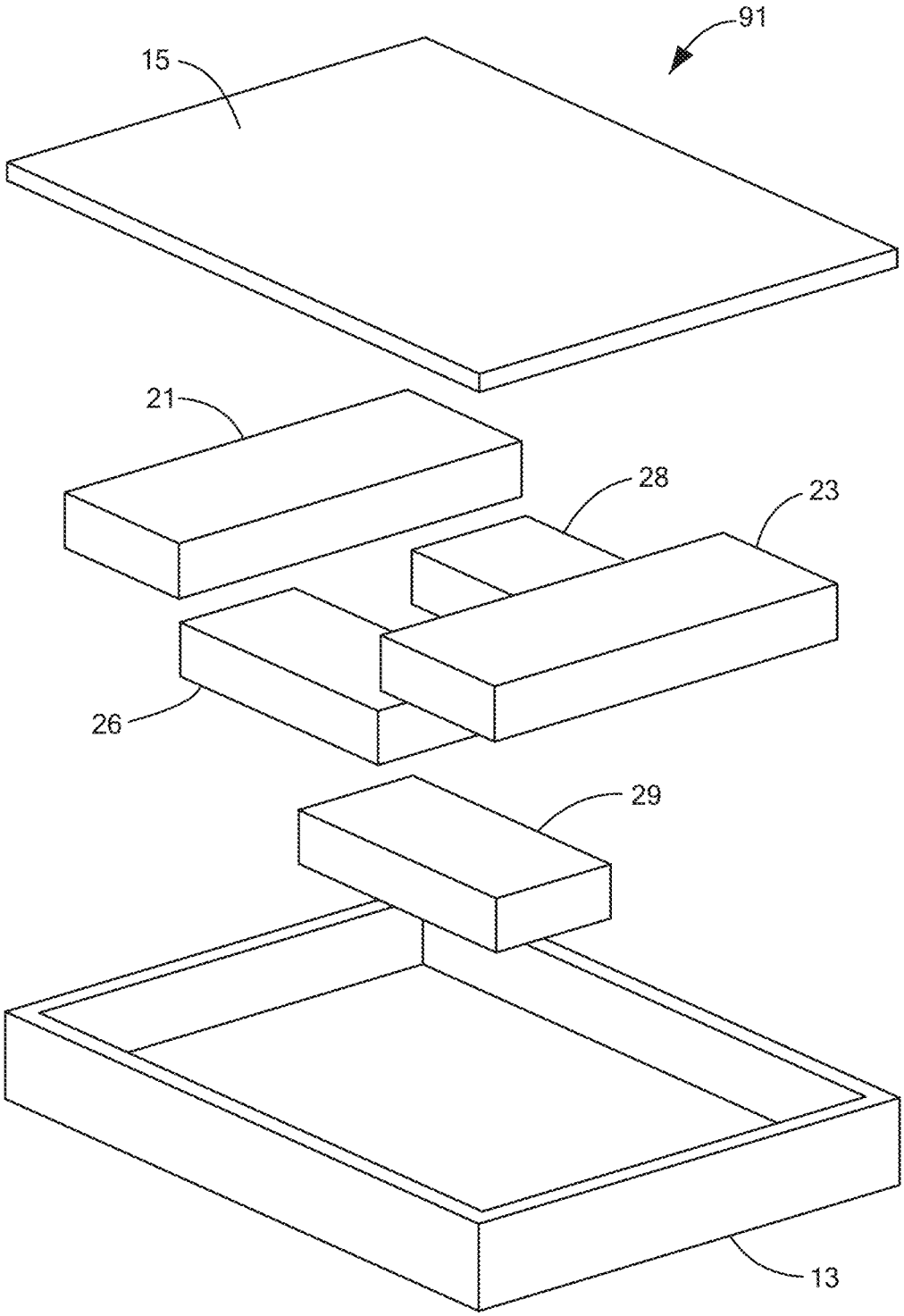
FIG. 6 is an exploded perspective view of a fourth embodiment of a thermally insulated shipping system that may be used to transport a parcel-sized payload, the thermally insulated shipping system being constructed according to the teachings of the present invention.

Referring now to FIG. 6, there is shown an exploded perspective view of a fourth embodiment of a thermally insulated shipping system that may be used to transport a parcel-sized payload, the thermally insulated shipping system being constructed according to the present invention and being represented generally by reference numeral 91. Details of system 91 that are discussed elsewhere in this application or that are not critical to an understanding of the invention may be omitted from FIG. 6 or from the accompanying description herein or may be shown in FIG. 6 and/or described herein in a simplified manner.

System 91 is similar in most respects to system 71, the principal difference between the two systems being that, in system 91, bottom thermally conductive member 17 is omitted.

Figure 7:
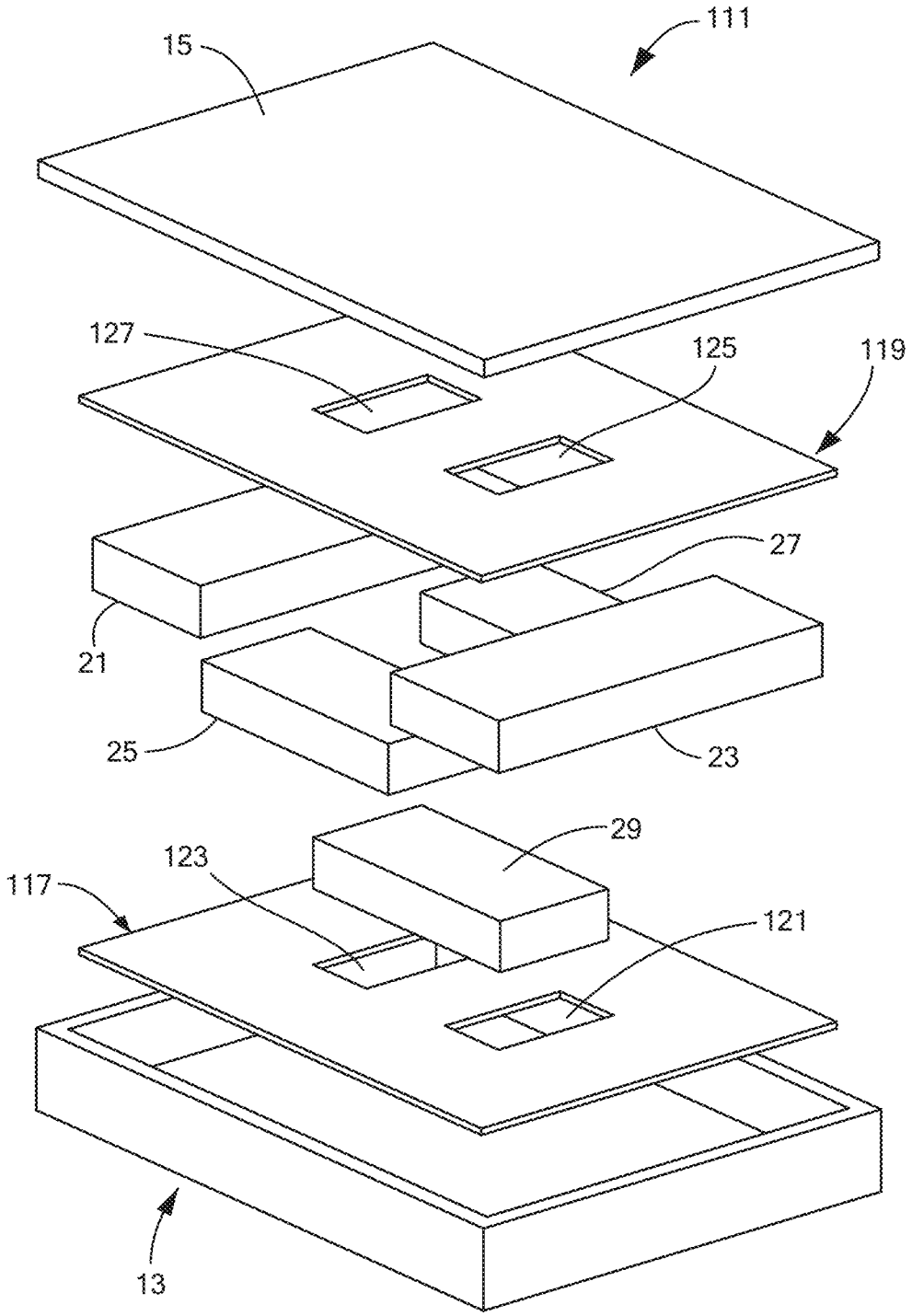
FIG. 7 is an exploded perspective view of a fifth embodiment of a thermally insulated shipping system that may be used to transport a parcel-sized payload, the thermally insulated shipping system being constructed according to the teachings of the present invention.
Figure 8B:
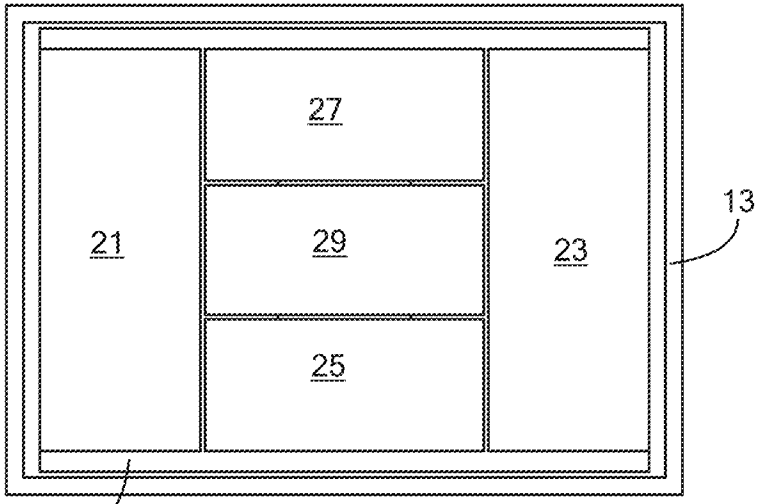
FIG. 8(*a*) is a top view of the thermally insulated shipping system of FIG. 7, with the thermally insulating lid removed.
Figure 8D:
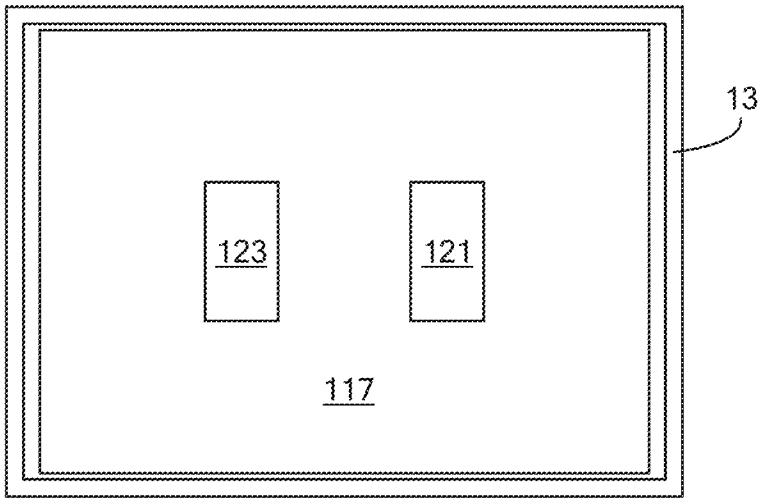
Figure 8A:
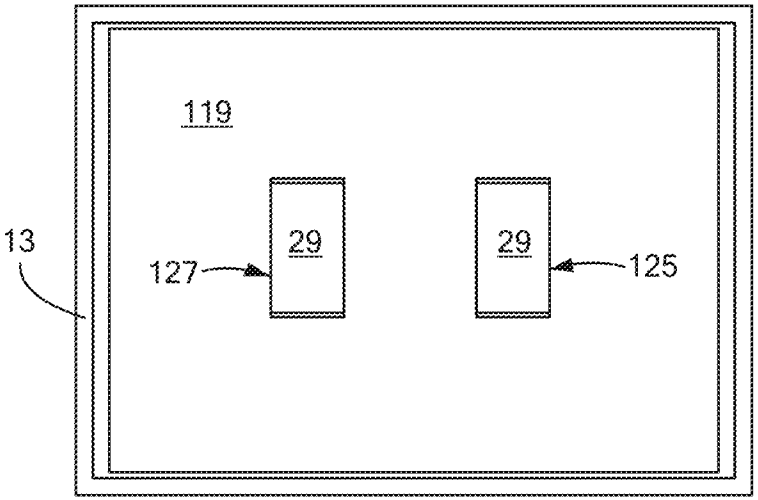
Figure 8C:
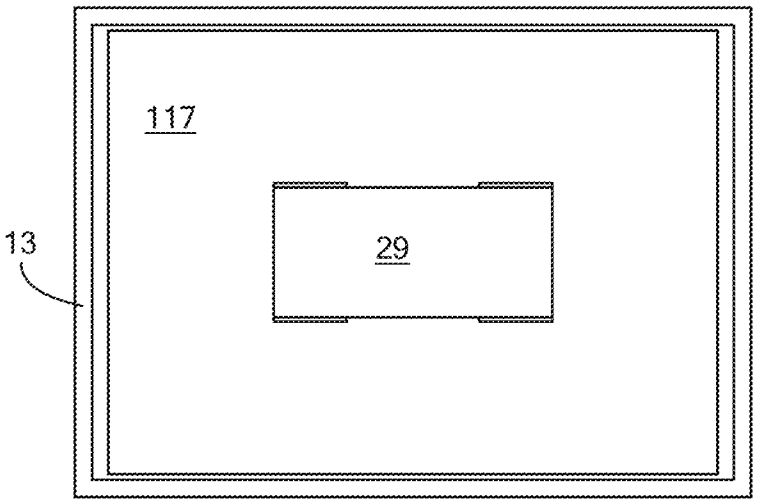

Referring now to FIGS. 7, 8(*a*), 8(*b*), 8(*c*), 8(*d*) and 9, there are shown various views of a fifth embodiment of a thermally insulated shipping system that may be used to transport a parcel-sized payload, the thermally insulated shipping system being constructed according to the present invention and being represented generally by reference numeral 111. Details of system 111 that are discussed elsewhere in this application or that are not critical to an understanding of the invention may be omitted from one or more of FIGS. 7, 8(*a*), 8(*b*), 8(*c*), 8(*d*) and 9 or from the accompanying description herein or may be shown in one or more of FIGS. 7, 8(*a*), 8(*b*), 8(*c*), 8(*d*) and 9 and/or described herein in a simplified manner.

Figure 9:
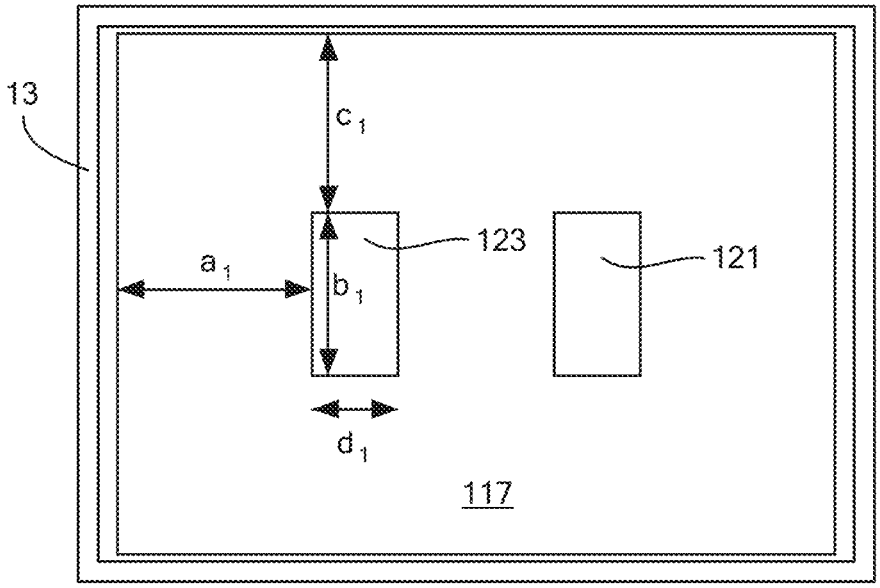
FIG. 9 is a top view of the thermally insulated shipping system of FIG. 8(*d*), with certain dimensions of the bottom thermally conductive member being shown.

System 111 may be similar in many respects to system 11, the principal difference between the two systems being that, whereas system 11 may comprise bottom thermally conductive member 17 and top thermally conductive member 19, system 111 may comprise bottom thermally conductive layer or member 117 and top thermally conductive layer or member 119. Bottom thermally conductive member 117 may differ from bottom thermally conductive member 17 in that bottom thermally conductive member 117 may comprise a pair of transverse openings 121 and 123 positioned below payload box 29, and top thermally conductive member 119 may differ from top thermally conductive member 19 in that top thermally conductive member 119 may comprise a pair of transverse openings 125 and 127 positioned above payload box 29. Bottom thermally conductive member 117 and top thermally conductive member 119 may be identical to one another, with openings 121 and 123 of bottom thermally conductive member 117 being similarly dimensioned to one another and being symmetrically positioned on bottom thermally conductive member 117 and with openings 125 and 127 of top thermally conductive member 119 being similarly dimensioned to one another and being symmetrically positioned on top thermally conductive member 119. FIG. 9 shows the relative size and placement of opening 123 of bottom thermally conductive member 117 using distances "$a_1$," "$b_1$", "$c_1$" and "$d_1$." According to one embodiment, "$a_1$" may be 4.125 inches, "$b_1$" may be 3.75 inches, "$c_1$" may be 3.5 inches, and "$d_1$" may be 2 inches.

As can be appreciated, the provision of openings 121 and 123 in bottom thermally conductive member 117 and of openings 125 and 127 in top thermally conductive member 119 may lessen or otherwise modify the "heat-spreading" effects of bottom thermally conductive member 117 and top thermally conductive member 119, as compared to bottom thermally conductive member 17 and top thermally conductive member 19. Consequently, one may modify the effects of the top and/or bottom thermally conductive members, as needed, by modifying the number, size and placement of transverse openings in the top and/or bottom thermally conductive members. Such a modification in the effect of the "heat-spreaders" may be desirable, for example, based on the anticipated ambient temperature to which the system is to be exposed. Also, it is to be understood that, although transverse openings 121, 123, 125 and 127 are shown in the present embodiment as being generally rectangular in shape, transverse openings 121, 123, 125 and 127 are not limited to being generally rectangular in shape and may have any shape. In other words, the shape of the openings may be tailored to achieve a particular "heat-spreading" effect. Moreover, the size, shape and placement of one opening may be the same as or different from that of another opening, either on the same conductive member or on another conductive member. Furthermore, although both of bottom thermally conductive member 117 and top thermally conductive member 119 are shown in the present embodiment as having openings, this need not be the case.

It is to be understood that one could further modify system 111 by eliminating bottom thermally conductive member 117 or top thermally conductive member 119 and/or by preconditioning some of temperature-control members 21, 23, 25, and 27 at different temperatures than others and/or by having some or all of temperature-control members 21, 23, 25, and 27 use one or more phase-change materials other than water or by replacing some of members 21, 23, 25, and 27 with a "dummy" member.

Figure 10:
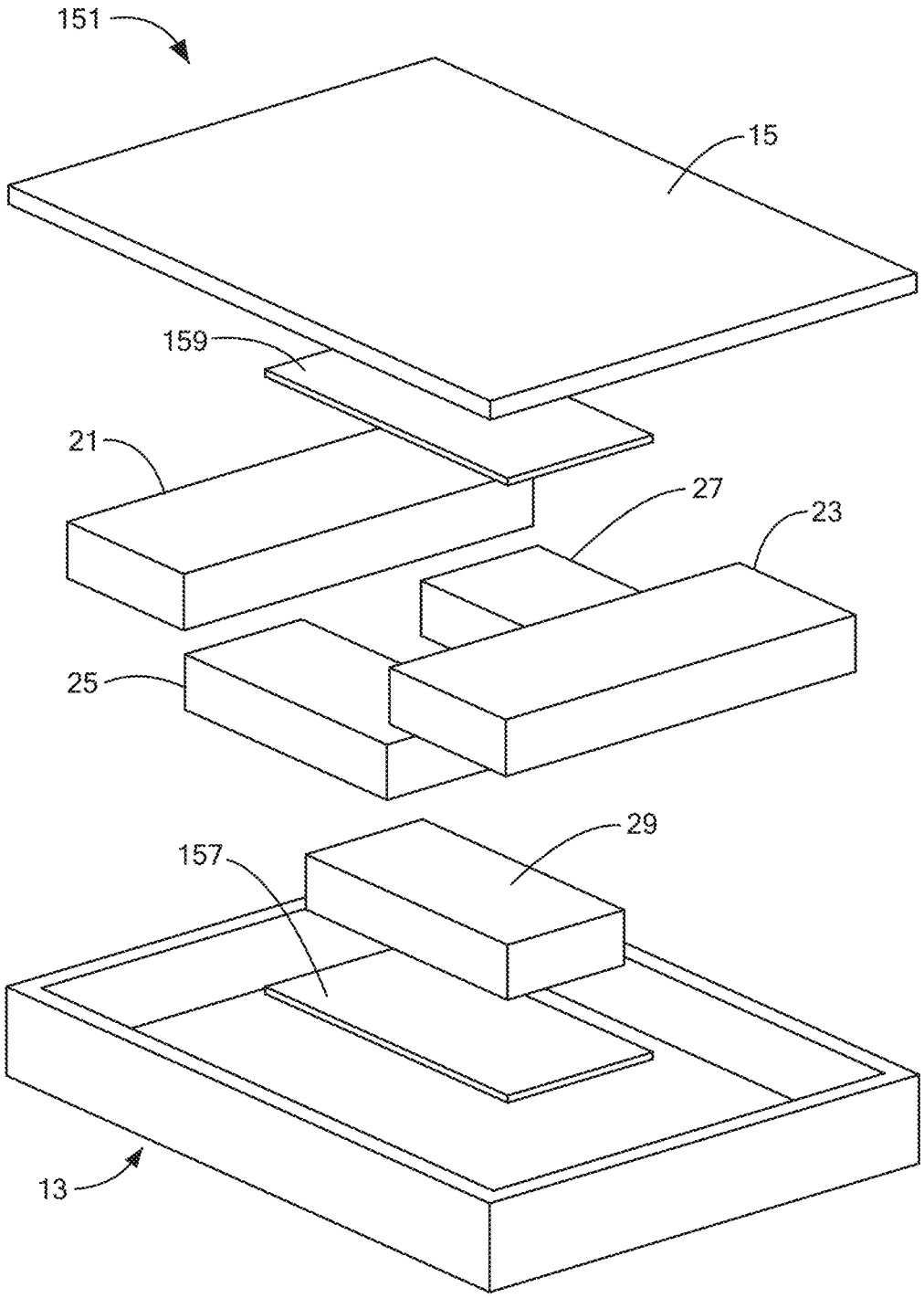
FIG. 10 is an exploded perspective view of a sixth embodiment of a thermally insulated shipping system that may be used to transport a parcel-sized payload, the thermally insulated shipping system being constructed according to the teachings of the present invention.
Figure 11A:
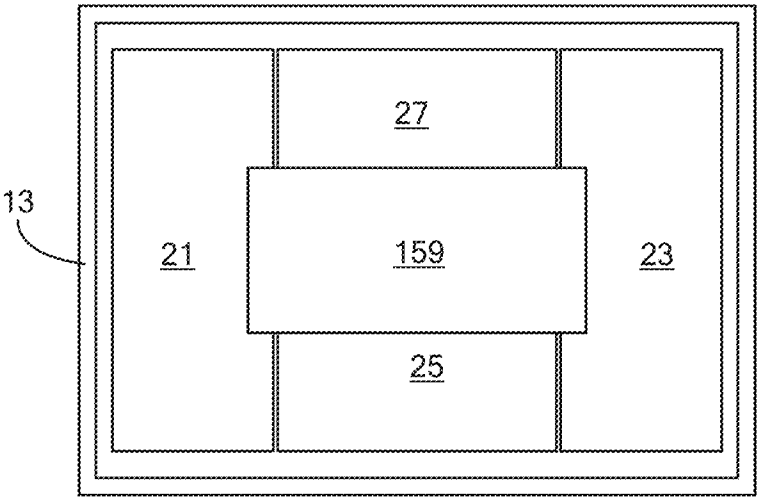
FIG. 11(*a*) is a top view of the thermally insulated shipping system of FIG. 10, with the thermally insulating lid removed.
Figure 11B:
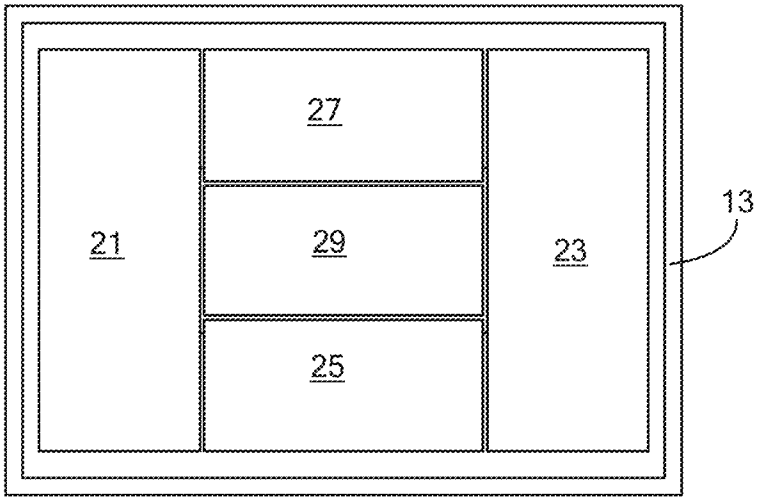
Figure 11C:
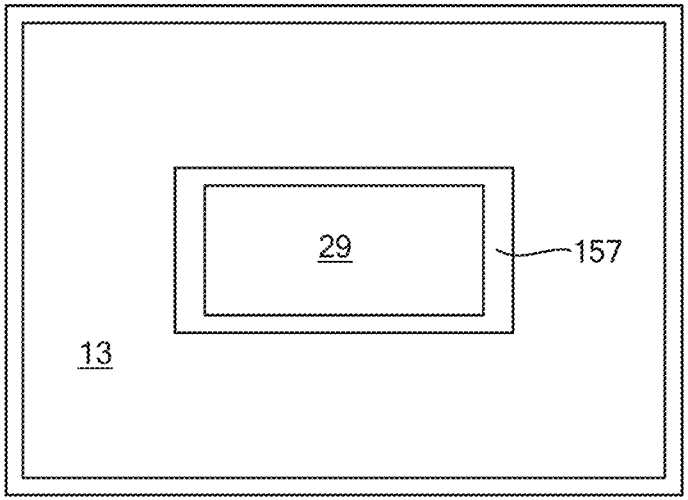
Figure 11D:
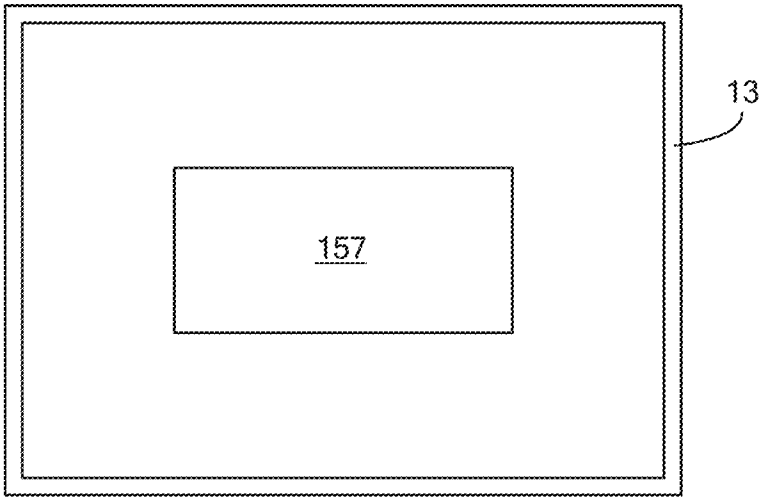

Referring now to FIGS. 10, 11(*a*), 11(*b*), 11(*c*), 11(*d*) and 12, there are shown various views of a sixth embodiment of a thermally insulated shipping system that may be used to transport a parcel-sized payload, the thermally insulated shipping system being constructed according to the present invention and being represented generally by reference numeral 151. Details of system 151 that are discussed elsewhere in this application or that are not critical to an understanding of the invention may be omitted from one or more of FIGS. 10, 11(*a*), 11(*b*), 11(*c*), 11(*d*) and 12 or from the accompanying description herein or may be shown in one or more of FIGS. 10, 11(*a*), 11(*b*), 11(*c*), 11(*d*) and 12 and/or described herein in a simplified manner.

Figure 12:
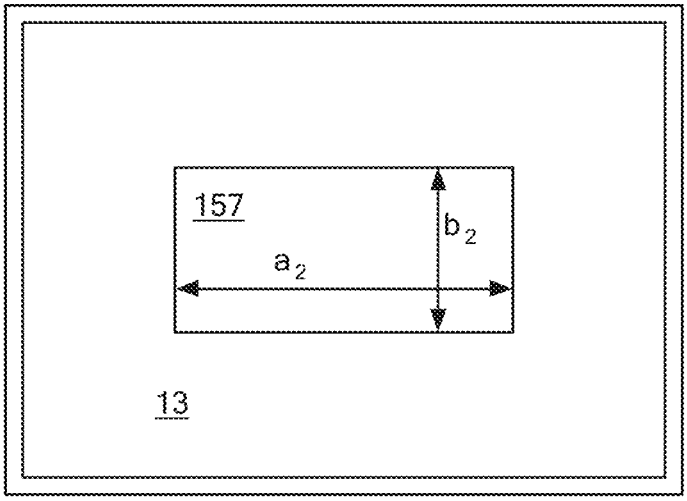
FIG. 12 is a top view of the thermally insulated shipping system of FIG. 11(*d*), with certain dimensions of the bottom thermally conductive member being shown.

System 151 may be similar in many respects to system 11, the principal difference between the two systems being that, whereas system 11 may comprise bottom thermally conductive member 17 and top thermally conductive member 19, system 151 may comprise bottom thermally conductive layer or member 157 and top thermally conductive layer or member 159. Bottom thermally conductive member 157 may differ from bottom thermally conductive member 17 in that bottom thermally conductive member 157 may be sized to be only slightly larger than the footprint of payload box 29 whereas bottom thermally conductive member 17 may cover nearly the entirety of the top surface of bottom wall 14-1 of base 13. In like fashion, top thermally conductive member 159 may differ from top thermally conductive member 19 in that top thermally conductive member 159 may be sized to be only slightly larger than the footprint of payload box 29 whereas top thermally conductive member 159 may cover nearly the entirety of the bottom surface of lid 15. FIG. 12 shows the relative size and placement of bottom thermally conductive member 157 on base 13 using distances $a_2$ and $b_2$. According to one embodiment, "$a_2$" may be 9 inches, and "$b_2$" may be 4.3 inches. As can be seen in FIG. 12, bottom thermally conductive member 157 may be substantially centered relative to base 13.

As can be appreciated, the reduction in size of bottom thermally conductive member 157 and top thermally conductive member 159, as compared to bottom thermally conductive member 17 and top thermally conductive member 19, respectively, may lessen or otherwise modify the "heat-spreading" effects of bottom thermally conductive member 157 and top thermally conductive 159, as compared to bottom thermally conductive member 17 and top thermally conductive member 19, respectively. Consequently, one may modify the effects of the top and/or bottom thermally conductive members, as needed, by modifying the size and/or placement of the top and/or bottom thermally conductive members. Such a modification in the effect of the "heat-spreaders" may be desirable, for example, based on the anticipated ambient temperature to which the system is to be exposed.

It is to be understood that one could modify system 151 by eliminating bottom thermally conductive member 157 or top thermally conductive member 159 and/or by preconditioning some of temperature-control members 21, 23, 25, and 27 at different temperatures than others and/or by having some or all of members 21, 23, 25, and 27 use one or more phase-change materials other than water or by replacing some of members 21, 23, 25, and 27 with a "dummy" member.

Figure 13A:
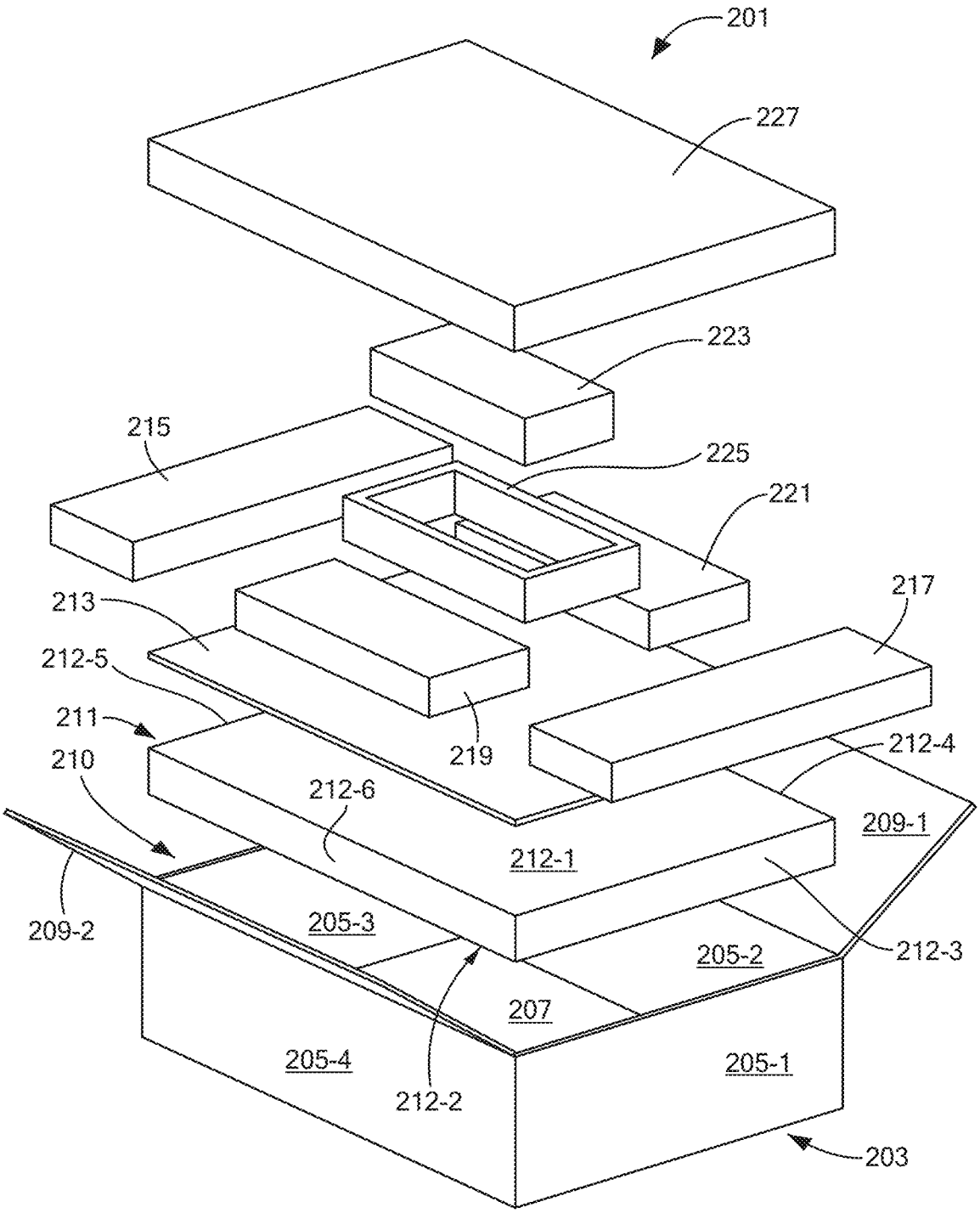
FIGS. 13(*a*) and 13(*b*) are exploded perspective and simplified section views, respectively, of a seventh embodiment of a thermally insulated shipping system that may be used to transport a parcel-sized payload, the thermally insulated shipping system being constructed according to the teachings of the present invention.
Figure 13B:
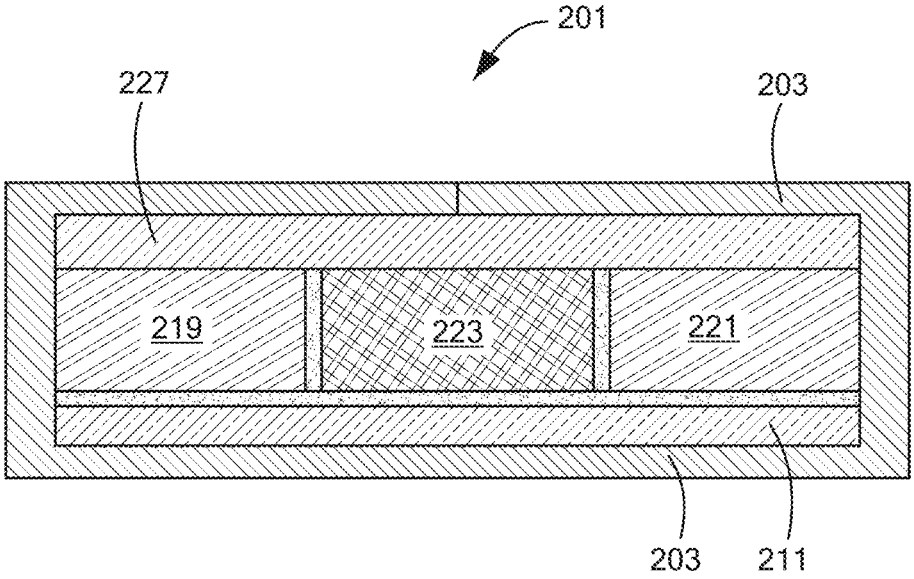

Referring now to FIGS. 13(*a*) and 13(*b*), there are shown various views of a seventh embodiment of a thermally insulated shipping system that may be used to transport a parcel-sized payload, the thermally insulated shipping system being constructed according to the present invention and being represented generally by reference numeral 201. Details of system 201 that are discussed elsewhere in this application or that are not critical to an understanding of the invention may be omitted from one or more of FIGS. 13(*a*) and 13(*b*) or from the accompanying description herein or may be shown in one or more of FIGS. 13(*a*) and 13(*b*) and/or described herein in a simplified manner.

System 201, which may be similar in some respects to system 51, may comprise a box 203. Box 203, which may consist of or comprise corrugated cardboard or the like, may be dimensioned to be snugly received within a standard-size courier box, such as a FedEx® Box—Large or a UPS® Large Express Box. Box 203 may be constructed to include four side walls 205-1 through 205-4, a bottom wall 207 (which may be formed by joining a pair of bottom panels), and a pair of closeable top panels 209-1 and 209-2. Side walls 205-1 through 205-4, bottom wall 207 and top panels 209-1 and 209-2 may collectively define a cavity 210, which may have a generally rectangular prismatic shape and which may be accessed from above while top panels 209-1 and 209-2 are in an open state.

System 201 may further comprise the following components, all of which may be disposed within cavity 210: a bottom insulation member 211, a thermally conductive layer or member 213, a plurality of temperature-control members 215, 217, 219, and 221, a payload box 223, an insulation frame 225, and a top insulation member 227.

Bottom insulation member 211, which may be in the form of a unitary block of generally rectangular prismatic shape, may comprise a top 212-1, a bottom 212-2, and four sides 212-3 through 212-6. Bottom insulation member 211, which may be dimensioned to sit snugly within cavity 210 on top of bottom wall 207 of box 203, may consist of or may comprise a suitable thermally insulating material. For example, bottom insulation member 211 may consist of or may comprise, but is not limited to, one or more of an expanded polystyrene, a polyurethane foam, and one or more vacuum insulated panels.

Thermally conductive member 213 may be similar or identical in size, composition, and function to bottom thermally conductive member 17 of system 11. Thermally conductive member 213 may be removably or permanently mounted on top 212-1 of bottom insulation member 211 and may be sized to match the footprint of top 212-1. If desired, bottom insulation member 211 and thermally conductive member 213 may form a composite structure of the type described above.

Temperature-control members 215, 217, 219, and 221 may be similar to temperature-control members 21, 23, 25, and 27, respectively, of system 11 but may have a slightly reduced footprint to accommodate the presence of insulation frame 225. Each of temperature-control members 215, 217, 219, and 221 may be seated directly on top of thermally conductive member 213.

Insulation frame 225, which may be seated directly on top of thermally conductive member 213, may be a generally rectangular frame-like structure made of a thermally insulating material, such as, but not limited to, an expanded polystyrene, a polyurethane foam, or the like. In the present embodiment, insulation frame 225 may be a unitary structure; however, insulation frame 225 need not be a unitary structure and may comprise a plurality of joined or unjoined pieces. Insulation frame 225 may be shaped to define a cavity adapted to snugly receive payload box 223, and insulation frame 225 may serve to keep payload box 223 from coming into direct contact with temperature-control members 215, 217, 219, and 221. In this manner, insulation frame 225 may serve to keep payload box 223 and its contents from becoming too cold due to the effects of temperature-control members 215, 217, 219, and 221.

Payload box 223, which may be seated directly on top of thermally conductive member 213, may be identical or similar to payload box 29.

Top insulation member 227 may be similar in construction and footprint to bottom insulation member 211 and may be positioned directly on top of temperature-control members 215, 217, 219, and 221, payload box 223, and insulation frame 225.

One benefit of system 201, as compared to system 11, is that system 201 does not require the fabrication of an insulating component, like base 13, which is shaped to include a cavity for receiving the payload box and the temperature-control members. Instead, in system 201, the payload box and the temperature-control members are capable of being positioned on a planar member, i.e., bottom insulation member 211, which, in turn, is positioned within a box made of cardboard or the like. Consequently, system 201 may be easier to manufacture than system 11.

Figure 14:
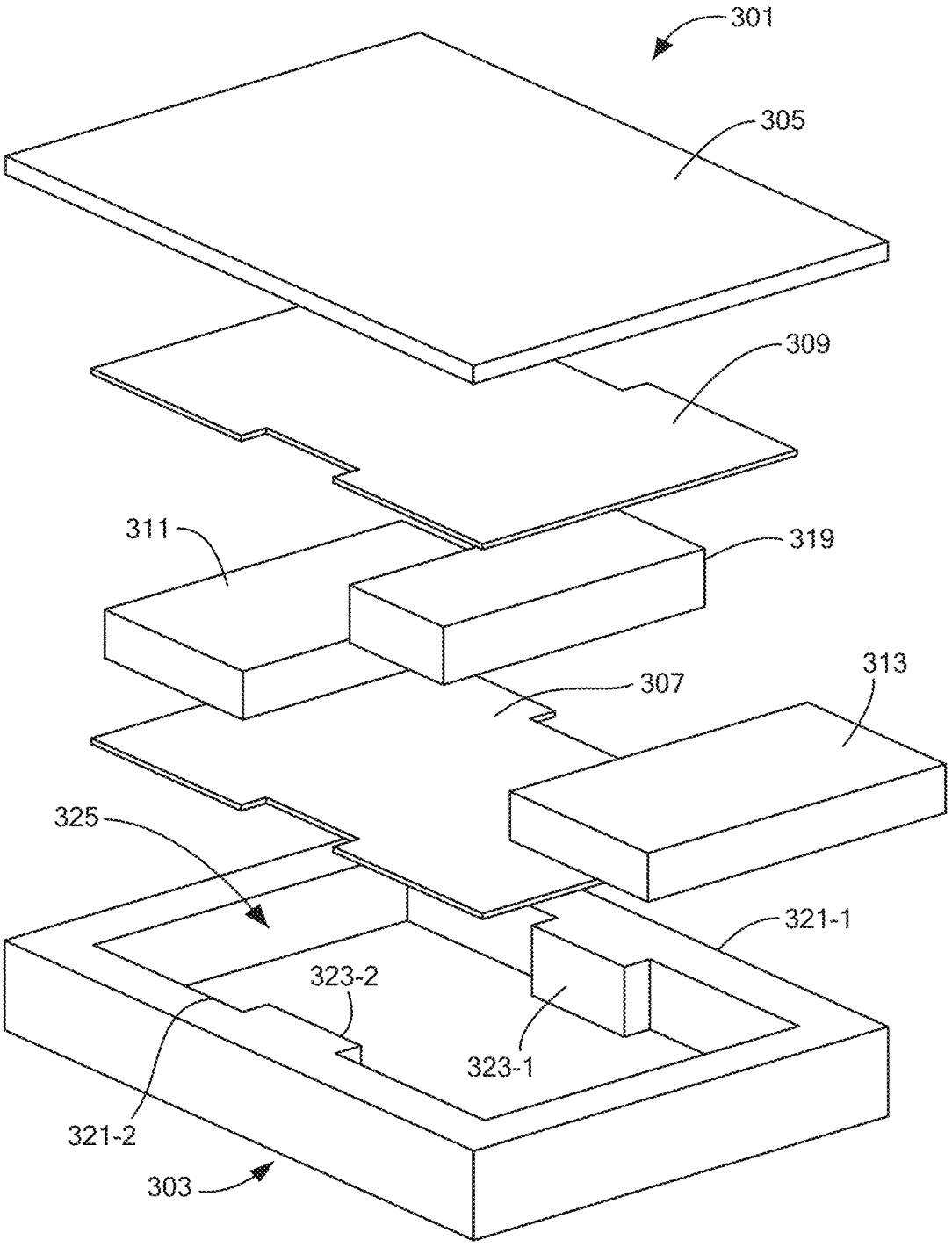
FIG. 14 is an exploded perspective view of an eighth embodiment of a thermally insulated shipping system that may be used to transport a parcel-sized payload, the thermally insulated shipping system being constructed according to the teachings of the present invention.

Referring now to FIG. 14, there is shown an exploded perspective view of an eighth embodiment of a thermally insulated shipping system that may be used to transport a parcel-sized payload, the thermally insulated shipping system being constructed according to the present invention and being represented generally by reference numeral 301. Details of system 301 that are discussed elsewhere in this application or that are not critical to an understanding of the invention may be omitted from FIG. 14 or from the accompanying description herein or may be shown in FIG. 14 and/or described herein in a simplified manner.

System 301 may comprise a thermally insulating base 303, a thermally insulating lid 305, a bottom thermally conductive layer or member 307, a top thermally conductive layer or member 309, two temperature-control members 311 and 313, and a payload box 319.

Thermally insulating base 303 may be similar in most respects to thermally insulating base 13 of system 11. One difference between the respective bases may be that, whereas base 13 is shaped to define a cavity 14-6 that is generally rectangular prismatic in shape, base 303 may be shaped to include a pair of opposing side walls 321-1 and 321-2, wherein side walls 321-1 and 321-2 have protrusions 323-1 and 323-2 that may be used in defining a cavity 325. As will be discussed further below, protrusions 323-1 and 323-2 may help to define spaces so that temperature-control members 311 and 313 and payload box 319 may be snugly received within cavity 325.

Bottom thermally conductive member 307 may be similar in most respects to bottom thermally conductive member 17 of system 11. One difference between the respective bottom thermally conductive members may be that, whereas bottom thermally conductive member 17 is rectangular in shape, bottom thermally conductive member 307 is complementarily shaped to fit within cavity 325 on the top surface of thermally insulating base 303.

Temperature-control members 311 and 313 may be similar to temperature-control members 21 and 23 of system 11 but may be dimensioned so that temperature-control member 311 may fit snugly within a first portion of cavity 325 that is located on one side of protrusions 323-1 and 323-2 and so that temperature-control member 313 may fit snugly within a second portion of cavity 325 that is located on the other side of protrusions 323-1 and 323-2. Temperature-control members 311 and 313 may be seated directly on top of bottom thermally conductive member 307.

Payload box 319 may be similar in most respects to payload box 29 of system 11. Payload box 319 may be dimensioned so that it may fit snugly within cavity 325 between protrusions 323-1 and 323-2, with one side of payload box 319 in contact with temperature-control member 311 and with the opposite side of payload box 319 in contact with temperature-control member 313. Payload box 319 may be seated directly on top of bottom thermally conductive member 307.

Top thermally conductive member 309 may be similar or identical to bottom thermally conductive member 307 and may be disposed within cavity 325, with top thermally conductive member 309 being seated directly on top of payload box 319 and temperature-control members 311 and 313.

Thermally insulating lid 305 may be similar or identical to lid 15 of system 11. Lid 305 may be removably mounted directly on top of base 303. Top thermally conductive member 309 may be removably or permanently coupled to lid 305.

Figure 15:
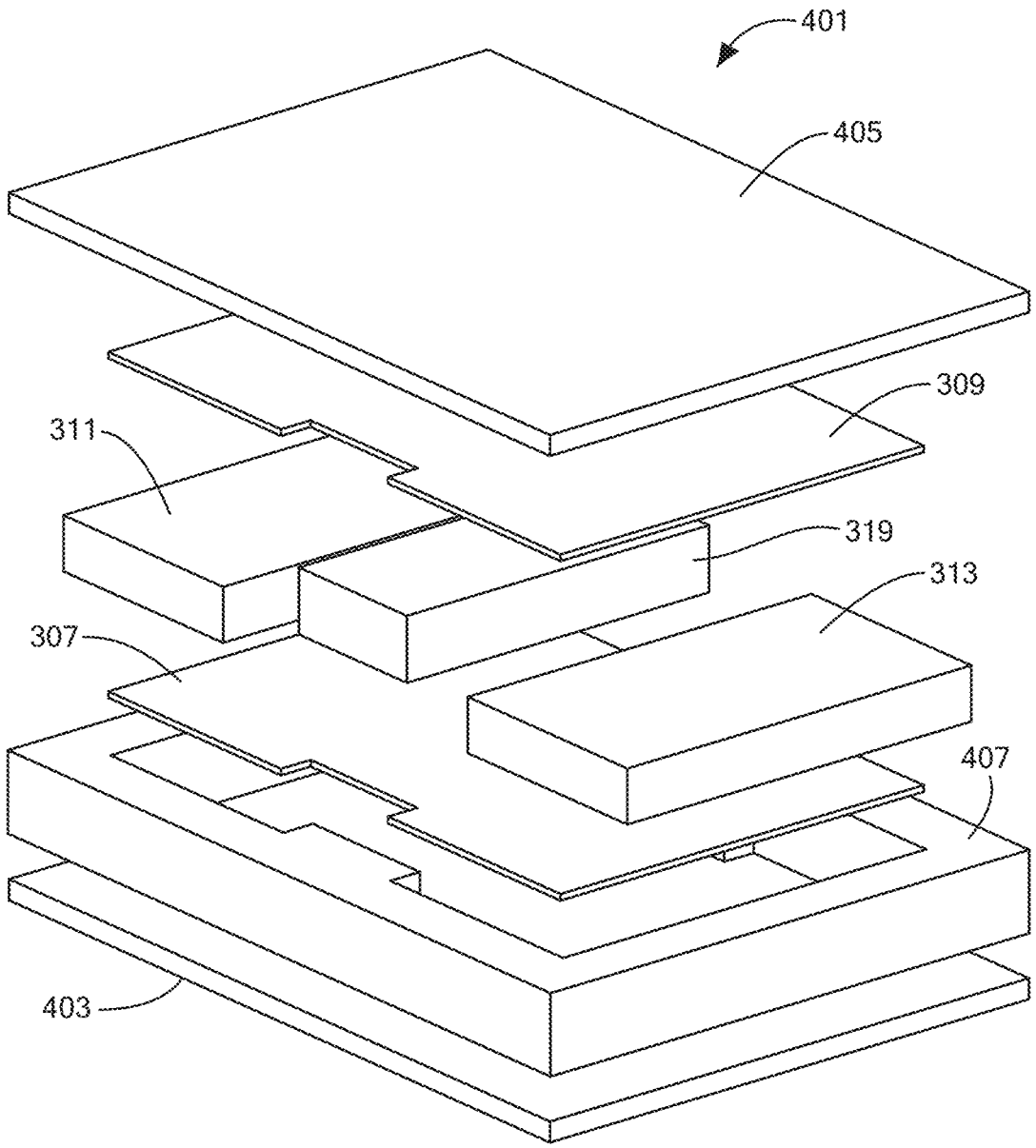
FIG. 15 is an exploded perspective view of a ninth embodiment of a thermally insulated shipping system that may be used to transport a parcel-sized payload, the thermally insulated shipping system being constructed according to the teachings of the present invention.

Referring now to FIG. 15, there is shown an exploded perspective view of a ninth embodiment of a thermally insulated shipping system that may be used to transport a parcel-sized payload, the thermally insulated shipping system being constructed according to the present invention and being represented generally by reference numeral 401. Details of system 401 that are discussed elsewhere in this application or that are not critical to an understanding of the invention may be omitted from FIG. 15 or from the accompanying description herein or may be shown in FIG. 15 and/or described herein in a simplified manner.

System 401 may be similar in many respects to system 301. One difference between the two systems may be that, whereas system 301 may comprise a thermally insulating base 303 and a thermally insulating lid 305, system 401 may comprise a thermally insulating base 403, a thermally insulating lid 405, and a thermally insulating frame 407.

Each of thermally insulating base 403 and thermally insulating lid 405 may be a generally planar member made of a first thermally insulating material. Thermally insulating frame 407, which may have a shape similar to the side walls of thermally insulating base 303 of system 301, may be made of a second thermally insulating material, which may be different than the first thermally insulating material used to make thermally insulating base 403 and thermally insulating lid 405. As can be appreciated, thermally insulating base 403 and thermally insulating frame 407 may collectively define a structure that is similar to thermally insulating base 303 of system 301.

Figure 16:
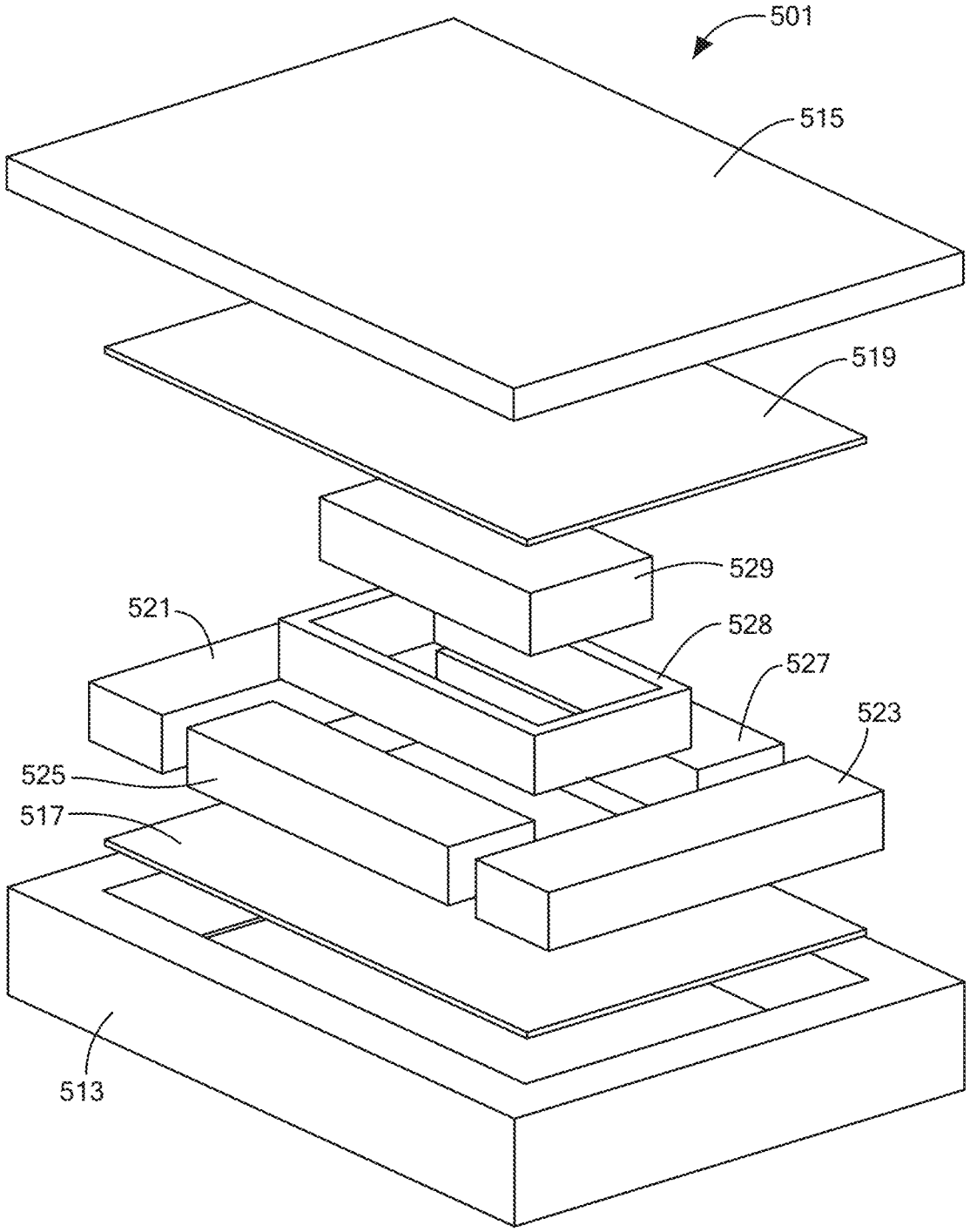
FIGS. 16, 17 and 18 are exploded perspective views, showing three different variations of a tenth embodiment of a thermally insulated shipping system that may be used to transport a parcel-sized payload, the thermally insulated shipping system being constructed according to the teachings of the present invention.
Figure 17:
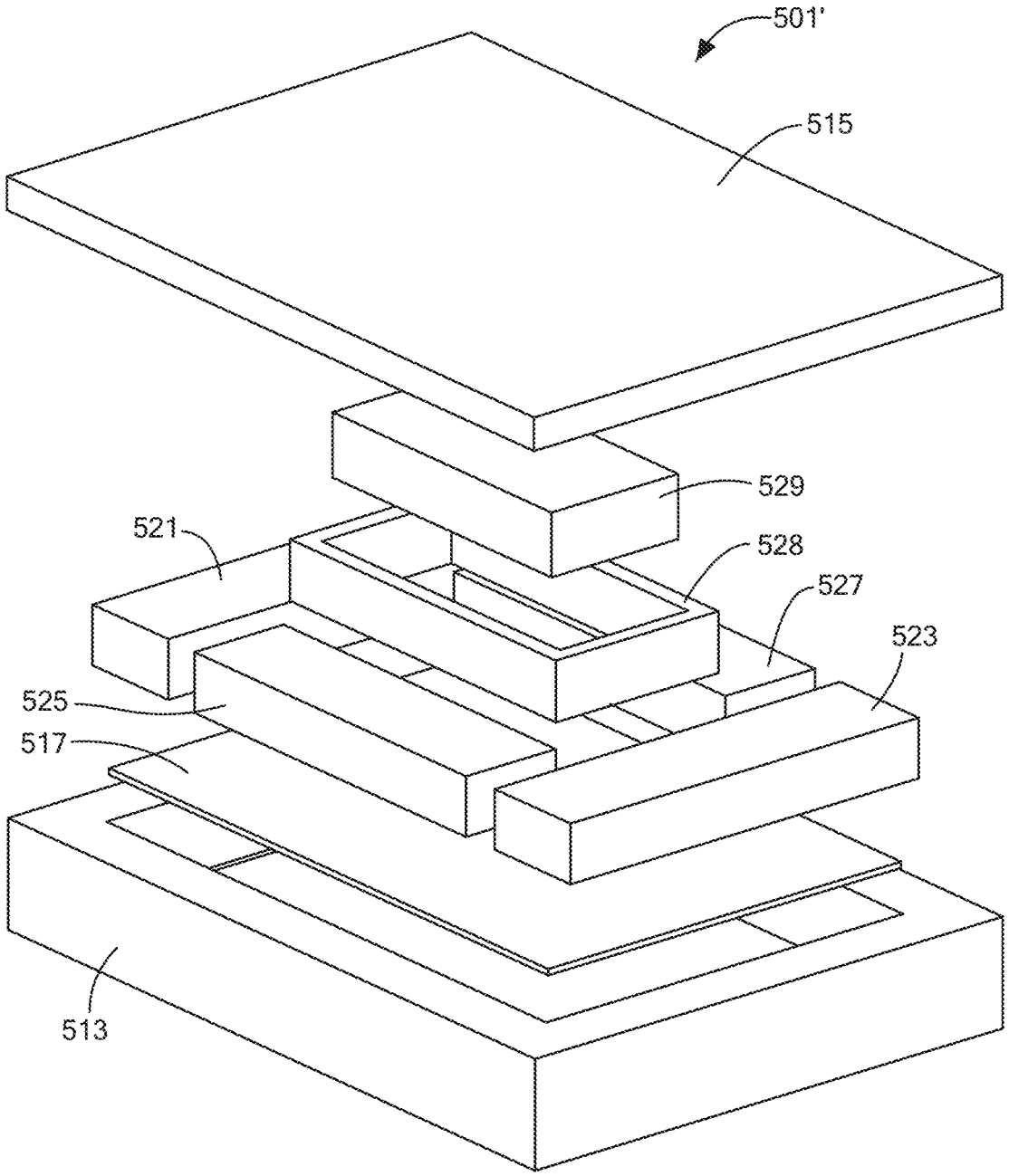
Figure 18:
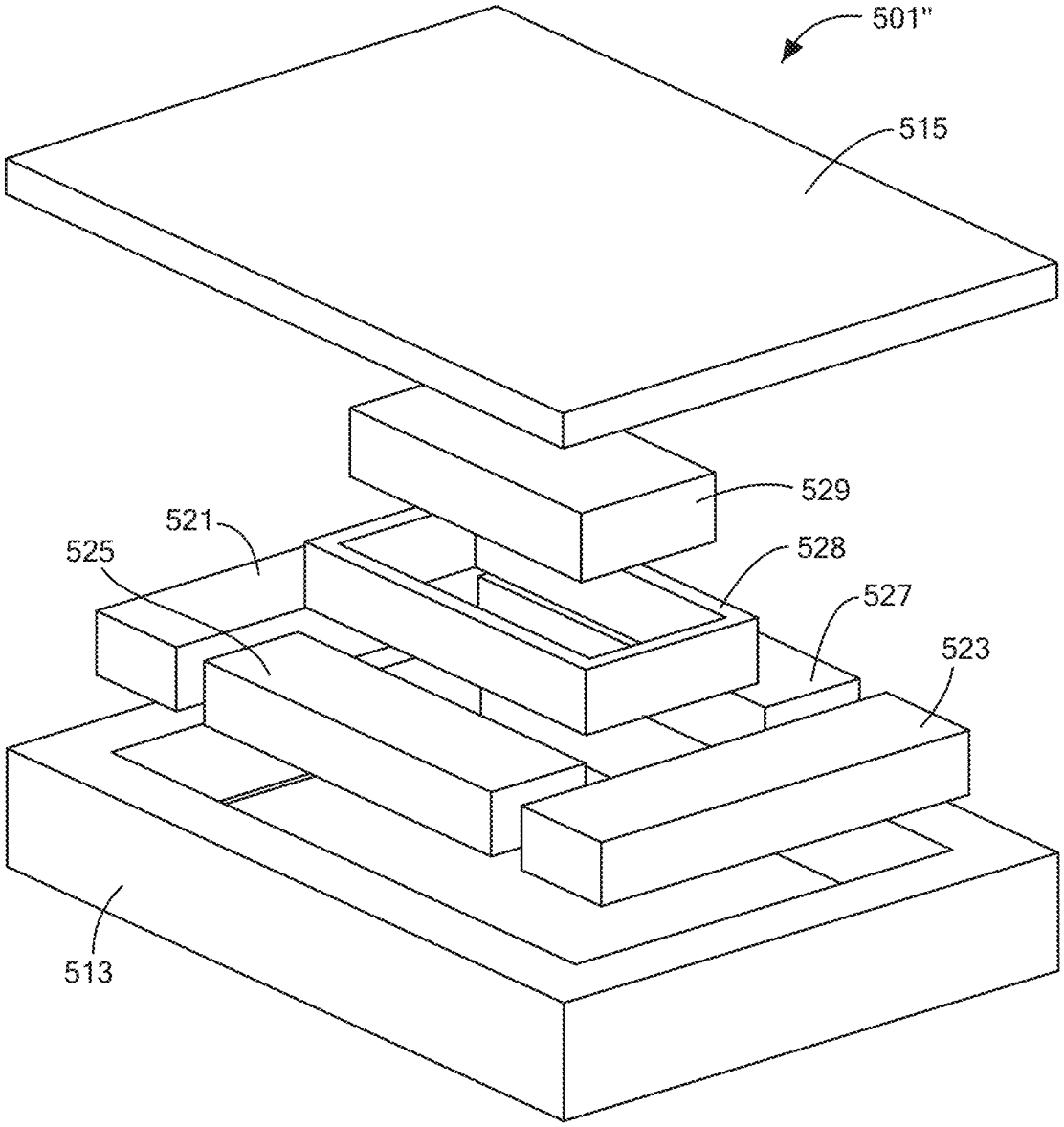

As alluded to above, one aspect of the present invention is the provision of a system that may be modified depending on the ambient temperature range to which it is expected to be exposed. Because different temperature ranges are often associated with seasonal temperatures (e.g., warmer temperatures in summer, cooler temperatures in winter, and moderate temperatures in spring and fall), such a system may be regarded as being amendable to seasonal design. FIGS. 16, 17 and 18 show three different variations of such a system.

More specifically, referring now to FIG. 16, there is shown an exploded perspective view of such a system, the system being represented generally by reference numeral 501. Details of system 501 that are discussed elsewhere in this application or that are not critical to an understanding of the invention may be omitted from FIG. 16 or from the accompanying description herein or may be shown in FIG. 16 and/or described herein in a simplified manner.

System 501 may be particularly well-suited for shipping payloads exposed to high ambient temperatures, such as approximately 25° C.-30° C. (i.e., a "summer packout"). System 501 may comprise a thermally insulating base 513, a thermally insulating lid 515, a bottom thermally conductive layer or member 517, a top thermally conductive layer or member 519, two large temperature-control members 521 and 523, two small temperature-control members 525 and 527, an insulation frame 528, and a payload box 529.

Thermally insulating base 513 may be similar or identical to thermally insulating base 13 of system 11, thermally insulating lid 515 may be similar or identical to thermally insulating lid 15 of system 11, bottom thermally conductive member 517 may be similar or identical to bottom thermally conductive member 17 of system 11, top thermally conductive member 519 may be similar or identical to top thermally conductive member 19 of system 11, and payload box 529 may be similar or identical to payload box 29 of system 11. Insulation frame 528 may be similar or identical to insulation frame 225 of system 201. For reasons to become apparent below, bottom thermally conductive member 517 is preferably not permanently affixed to thermally insulating base 513, and top thermally conductive member 519 is preferably not permanently affixed to thermally insulating lid 515.

Large temperature-control members 521 and 523 may be similar in some respects to large temperature-control members 21 and 23 of system 11, and small temperature-control members 525 and 527 may be similar in some respects to small temperature-control members 25 and 27 of system 11. One difference between the temperature-control members of the two systems may be that, whereas each of large temperature-control members 21 and 23 and small temperature-control members 25 and 27 of system 11 may comprise a water-based brick, each of large temperature-control members 521 and 523 and small temperature-control members 525 and 527 of system 501 may instead comprise a water-based gel that may be preconditioned at a preconditioning temperature of −5° C. In the present embodiment, the cumulative amount of water-based gel for system 501 may be approximately 4.8 lbs.

System 501 may be expected to maintain a payload within a temperature range of +2° C. to +8° C. for about 26 hours when exposed to ambient temperatures of +25° C. to +30° C.

Referring now to FIG. 17, there is shown an exploded perspective view of a system represented generally by reference numeral 501'. Details of system 501' that are discussed elsewhere in this application or that are not critical to an understanding of the invention may be omitted from FIG. 17 or from the accompanying description herein or may be shown in FIG. 17 and/or described herein in a simplified manner.

System 501' may be particularly well-suited for shipping payloads exposed to moderate ambient temperatures, such as approximately 10° C.-25° C. (i.e., a "moderate packout"). System 501' may be similar to system 501, the two systems differing from one another in that system 501' either may lack bottom thermally conductive member 517 or may lack top thermally conductive member 519.

System 501' may be expected to maintain a payload within a temperature range of +2° C. to +8° C. for about 34-36 hours when exposed to ambient temperatures of +10° C. to +25° C.

Referring now to FIG. 18, there is shown an exploded perspective view of a system represented generally by reference numeral 501". Details of system 501" that are discussed elsewhere in this application or that are not critical to an understanding of the invention may be omitted from FIG. 18 or from the accompanying description herein or may be shown in FIG. 18 and/or described herein in a simplified manner.

System 501" may be particularly well-suited for shipping payloads exposed to cold ambient temperatures, such as approximately 0° C.-10° C. (i.e., a "winter packout"). System 501" may be similar to system 501, the two systems differing from one another in that system 501" may lack both bottom thermally conductive member 517 and top thermally conductive member 519.

System 501" may be expected to maintain a payload within a temperature range of +2° C. to +8° C. for about 36 hours when exposed to ambient temperatures of +0° C. to +10° C.

As can be appreciated, one could regard the unassembled contents of system 501 as a kit from which any of systems 501, 501', and 501" may be assembled.

Figure 19:
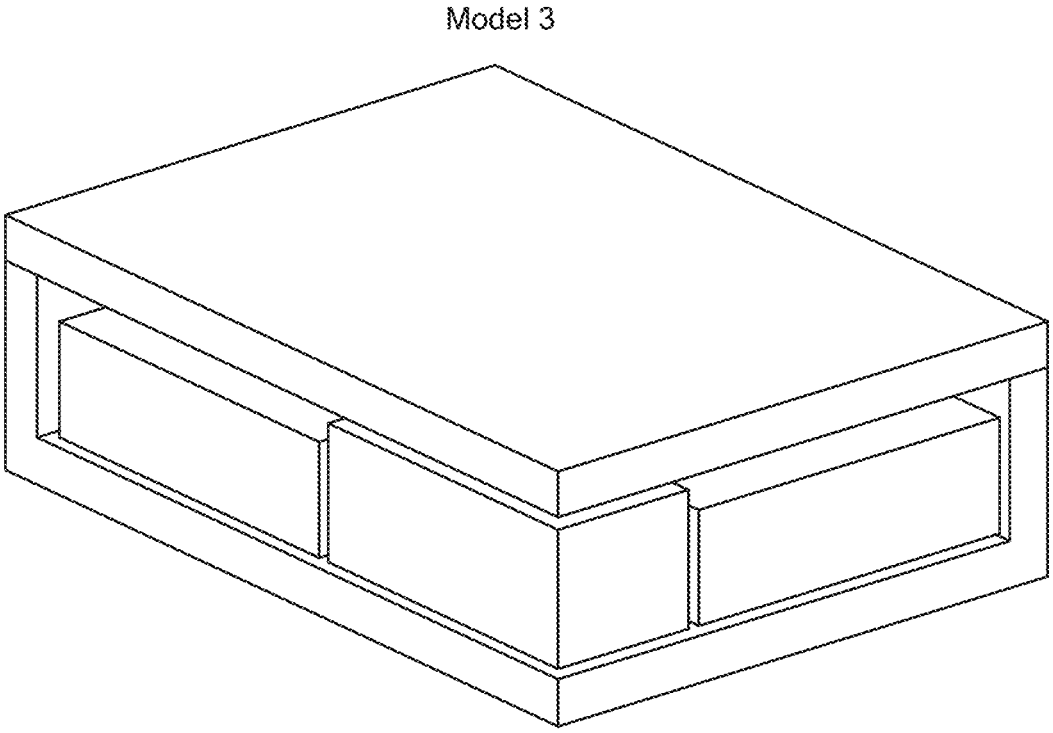
FIG. 19 is a fragmentary perspective view, broken away in part, of a first simulated model of a thermally insulated shipping system, the first simulated model lacking a thermally conductive member.
Figure 20:
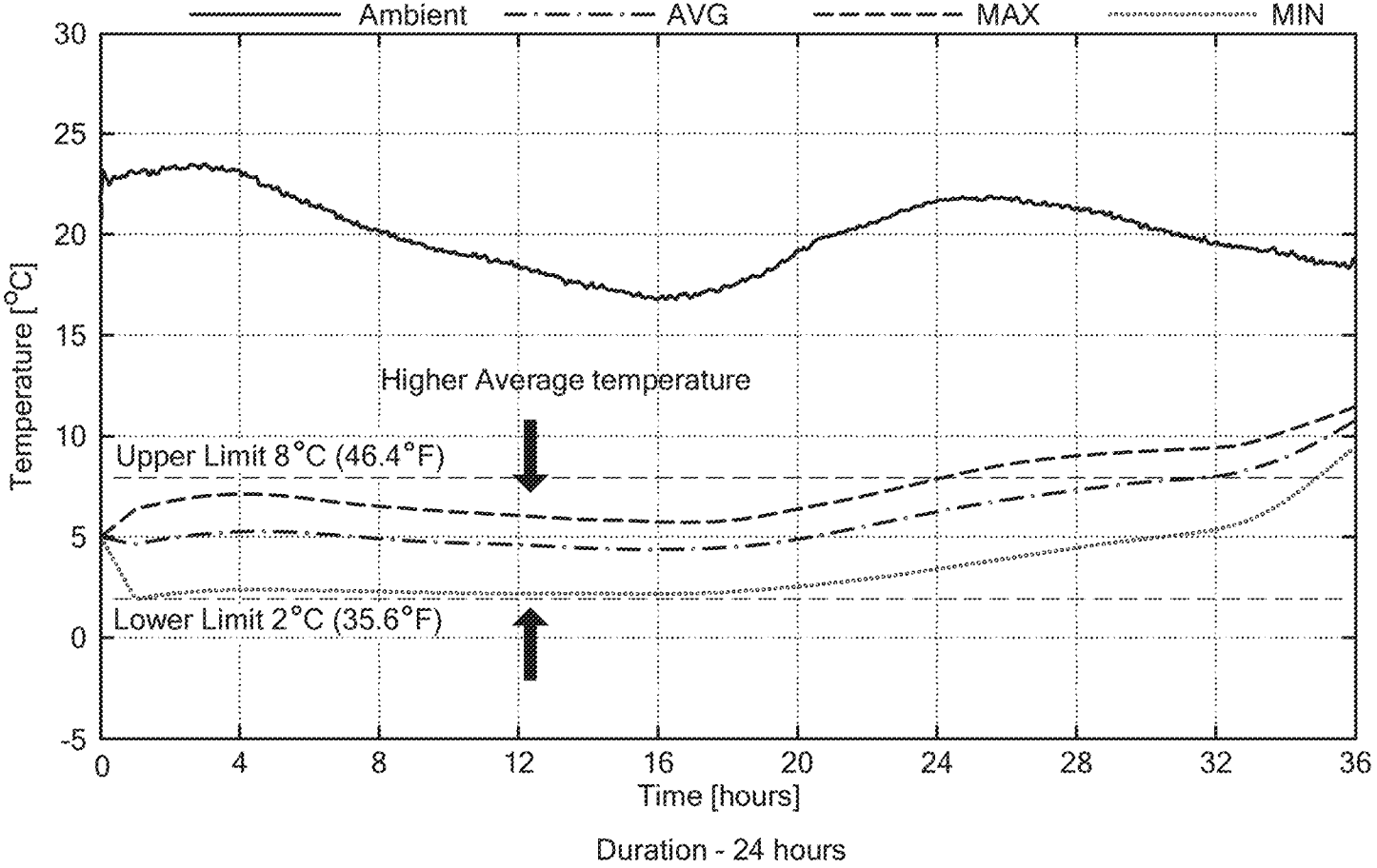
FIG. 20 is a graph of a simulation showing the temperature, as a function of time, of the payload in the first simulated model of FIG. 19.
Figure 21:
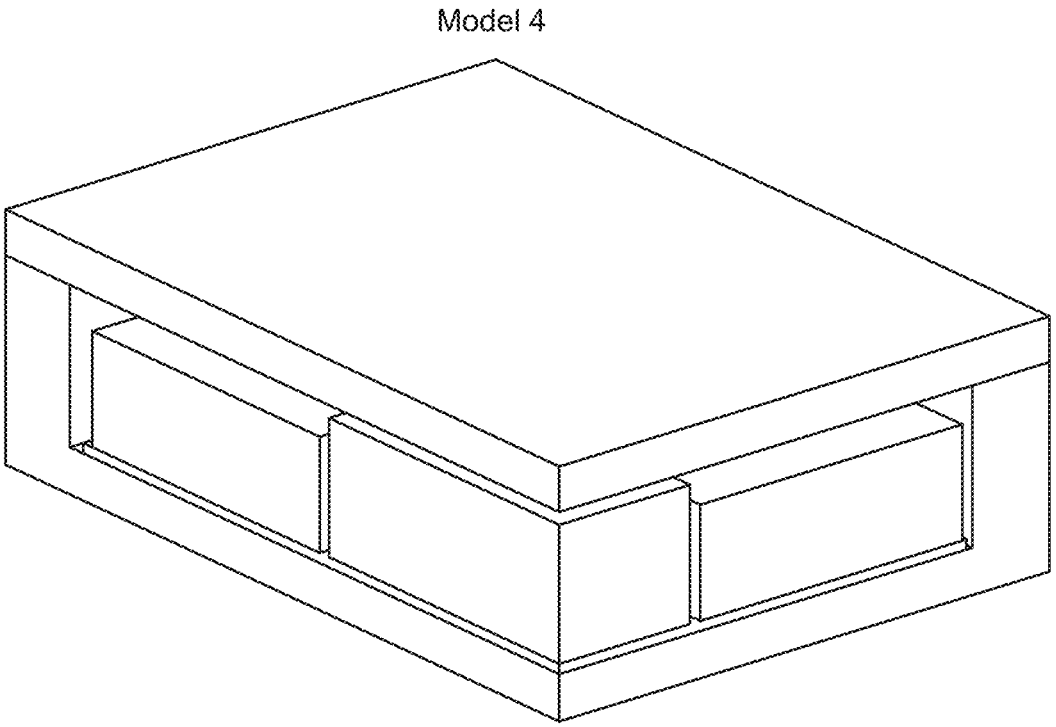
FIG. 21 is a fragmentary perspective view, broken away in part, of a second simulated model of a thermally insulated shipping system, the second simulated model differing from that of FIG. 19 in that a bottom thermally conductive member is present.
Figure 22:
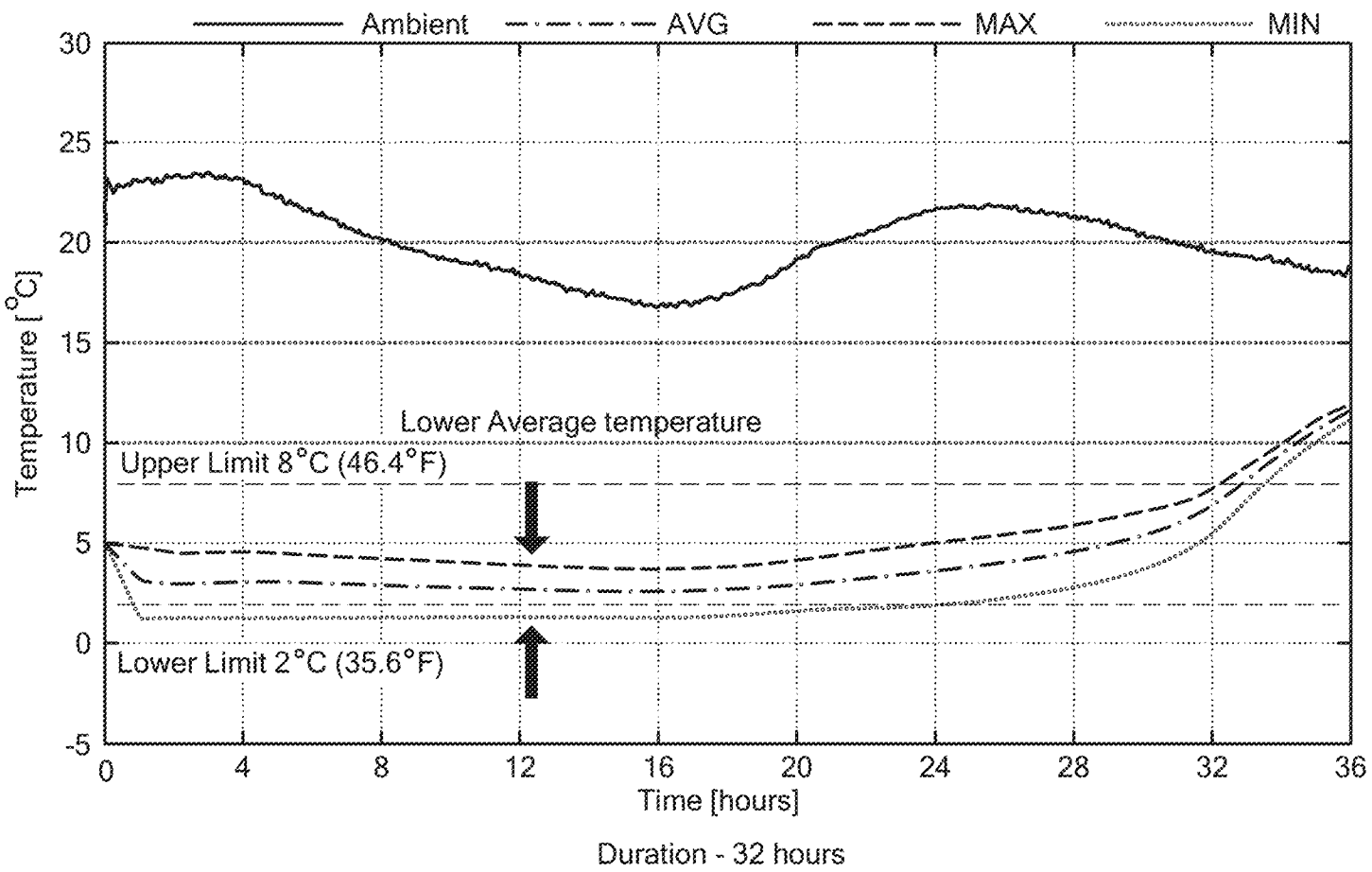
FIG. 22 is a graph of a simulation showing the temperature, as a function of time, of the payload in the second simulated model of FIG. 21.
Figure 23:
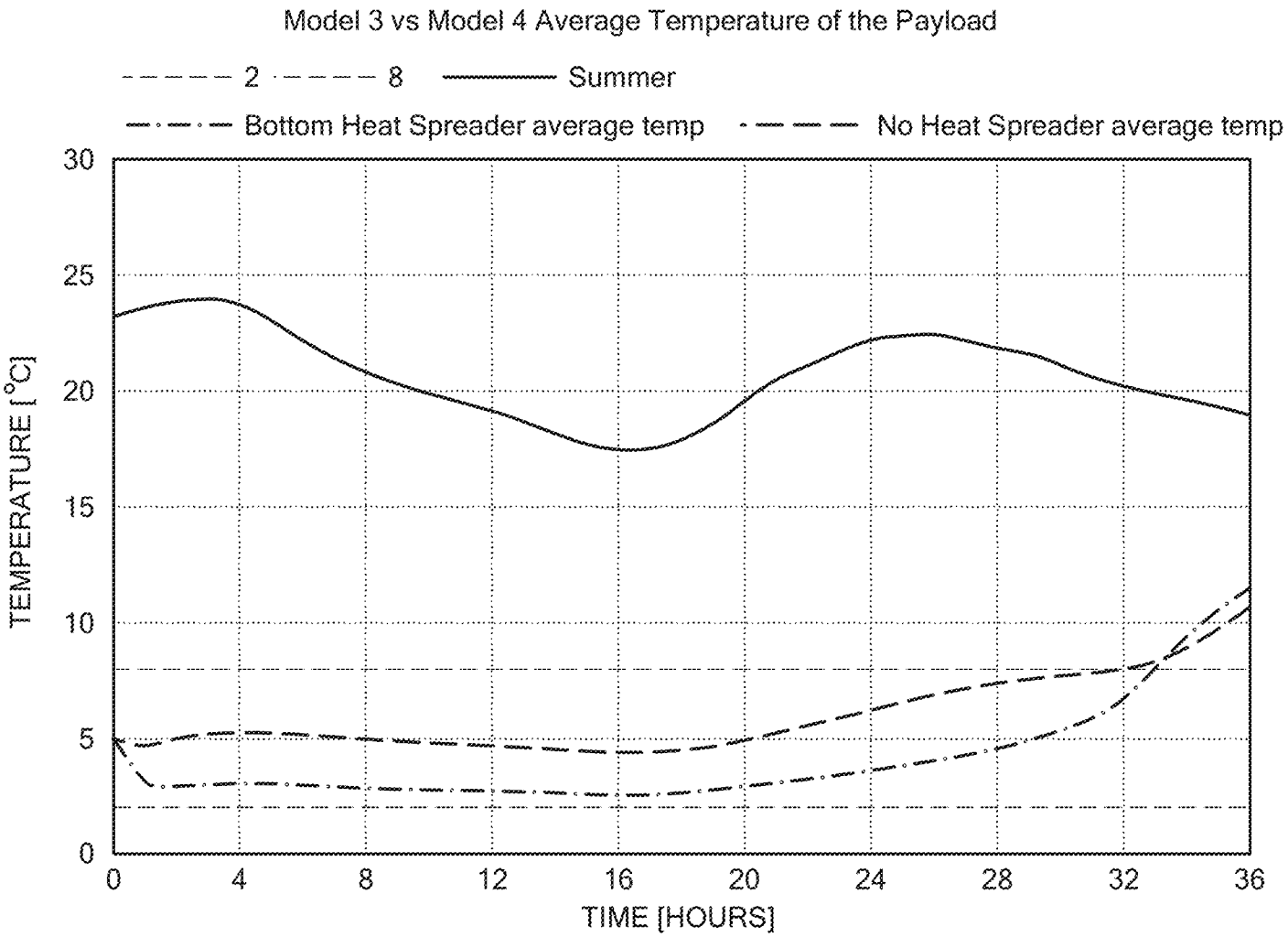
FIG. 23 is a graph showing the average temperatures, as a function of time, of the payloads in the simulated models of FIGS. 19 and 21.

Referring now to FIG. 19, there is shown a fragmentary (i.e., quartered) perspective view, broken away in part, of a first simulated model of a thermally insulated shipping system (also referred to as "Model 3"), the first simulated model lacking a thermally conductive member. FIG. 20 is a graph of a simulation showing the temperature, as a function of time, of the payload in the simulated model of FIG. 19. FIG. 21 is a fragmentary (i.e., quartered) perspective view, broken away in part, of a second simulated model of a thermally insulated shipping system (also referred to as "Model 4"), the second simulated model differing from that of FIG. 19 in that a bottom thermally conductive member is present. FIG. 22 is a graph of a simulation showing the temperature, as a function of time, of the payload in the simulated model of FIG. 21. As can be seen by comparing FIGS. 20 and 22, the second simulated model has a lower average temperature than that of the first simulated model and keeps the payload at a temperature below the upper limit of 8° C. for a longer period of time. A comparison of the first and second simulated models is also provided in FIG. 23.

Figure 24A:
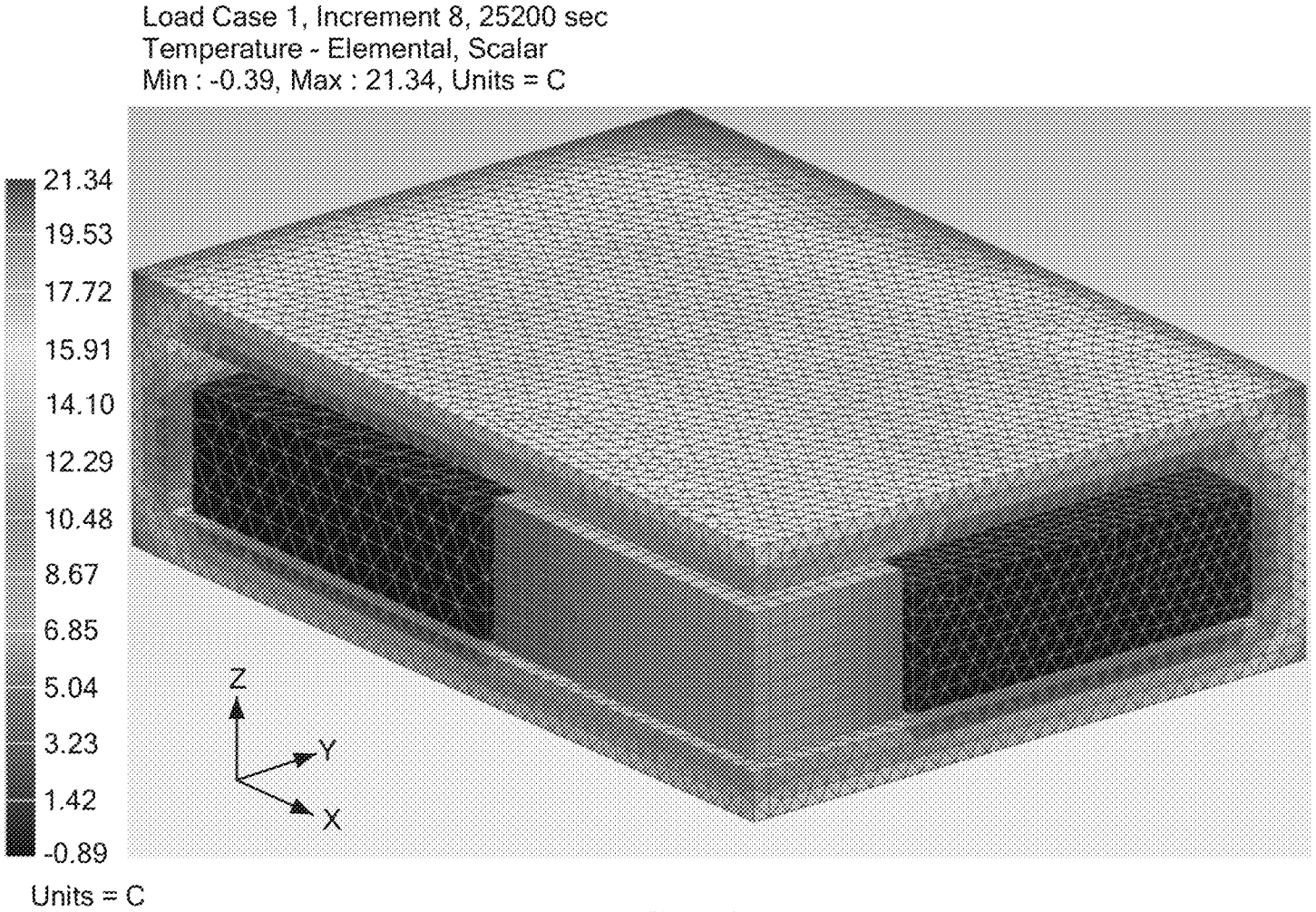
FIGS. 24(*a*) and 24(*b*) are graphic depictions of the temperature distribution, after 7 hours, in the simulated models of FIGS. 19 and 21, respectively.
Figure 24B:
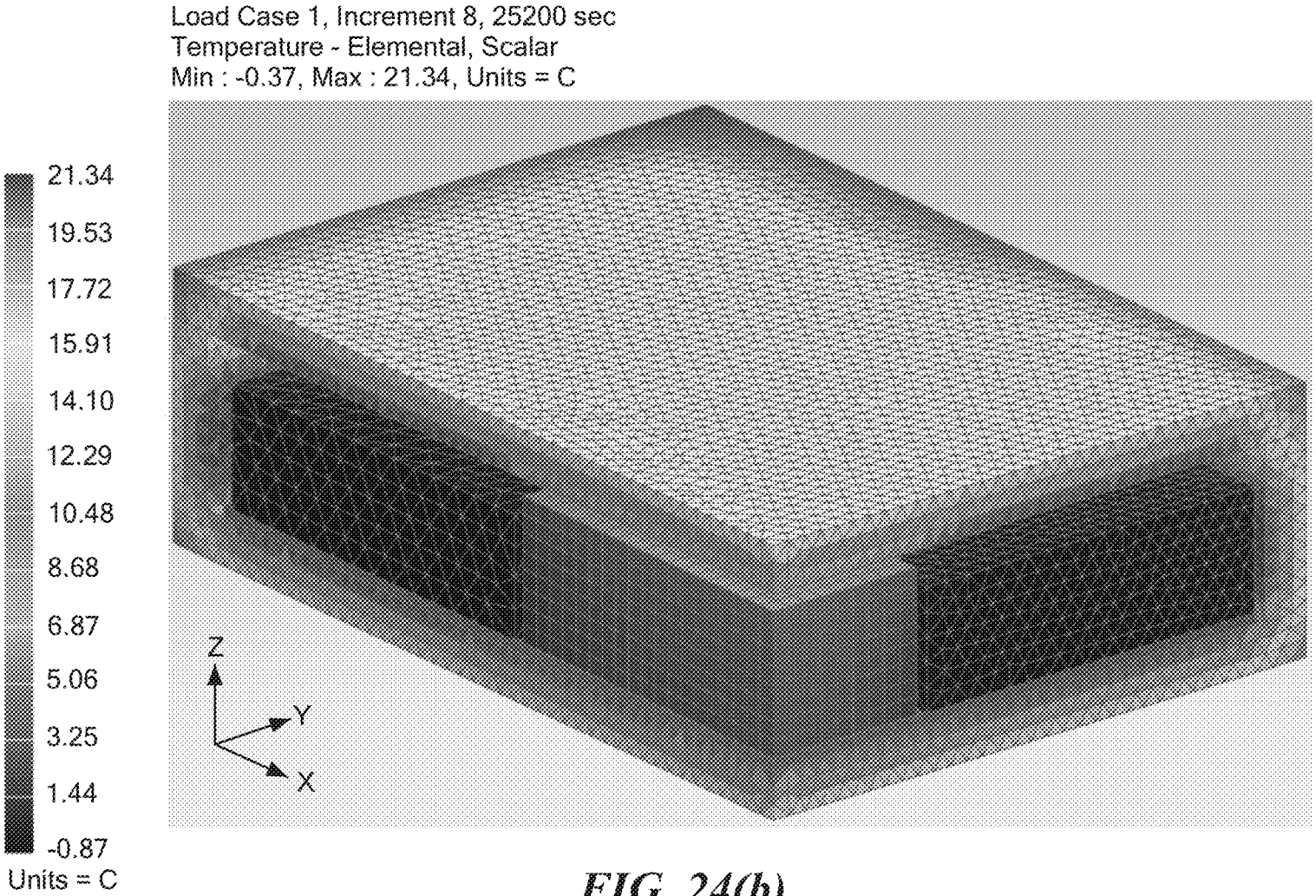
Figure 25A:
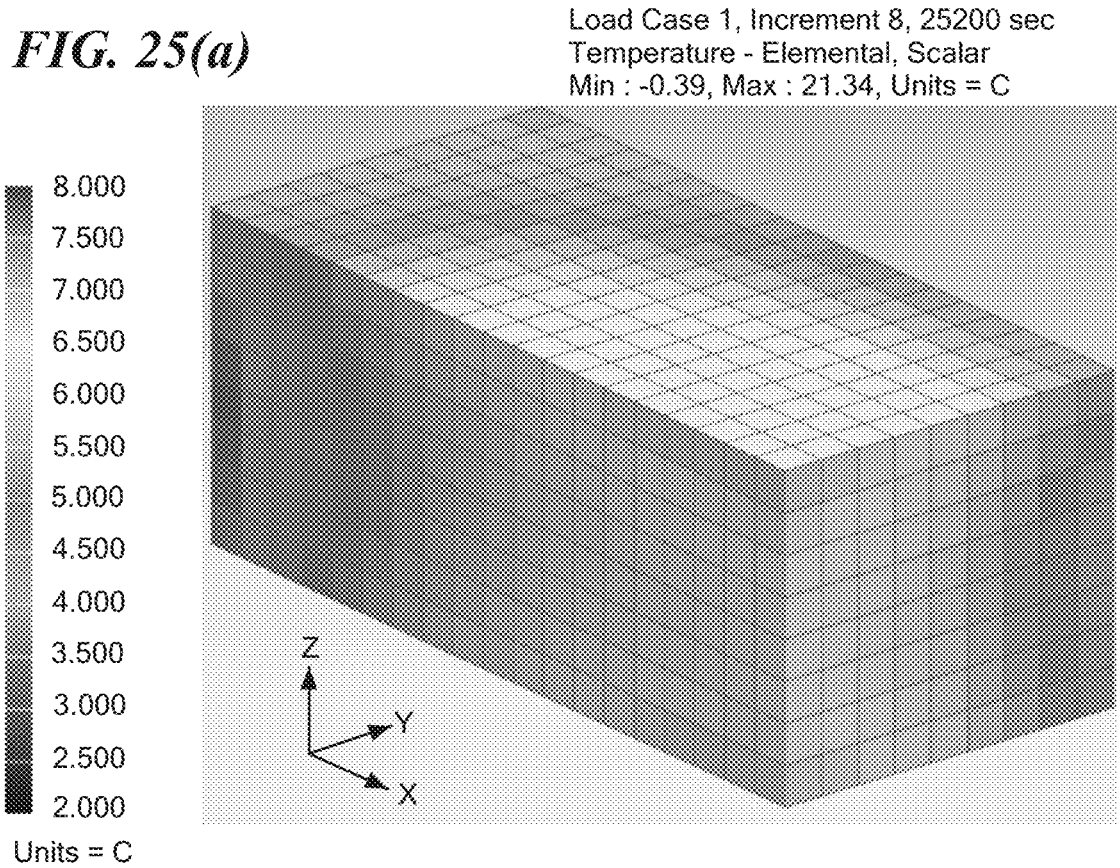
FIGS. 25(*a*) and 25(*b*) are graphic depictions of the temperature distribution, after 7 hours, in the payloads of the simulated models of FIGS. 19 and 21, respectively.
Figure 25B:
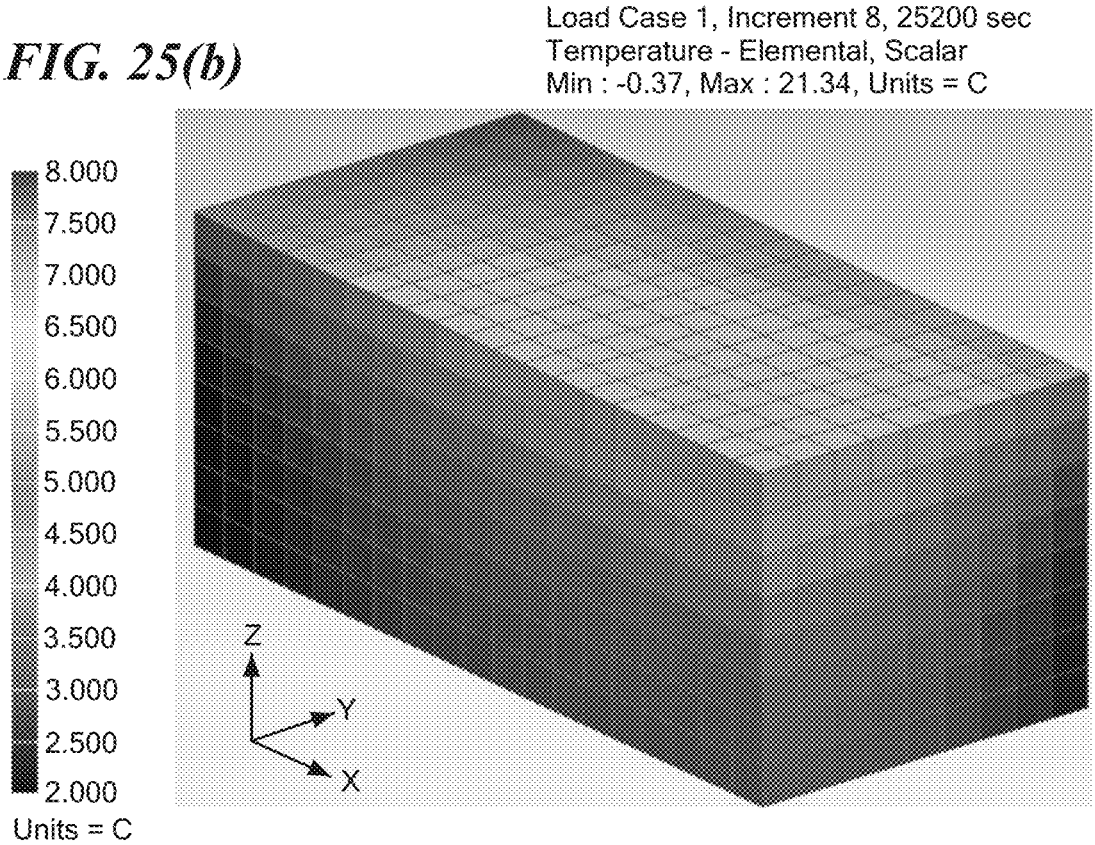
Figure 26A:
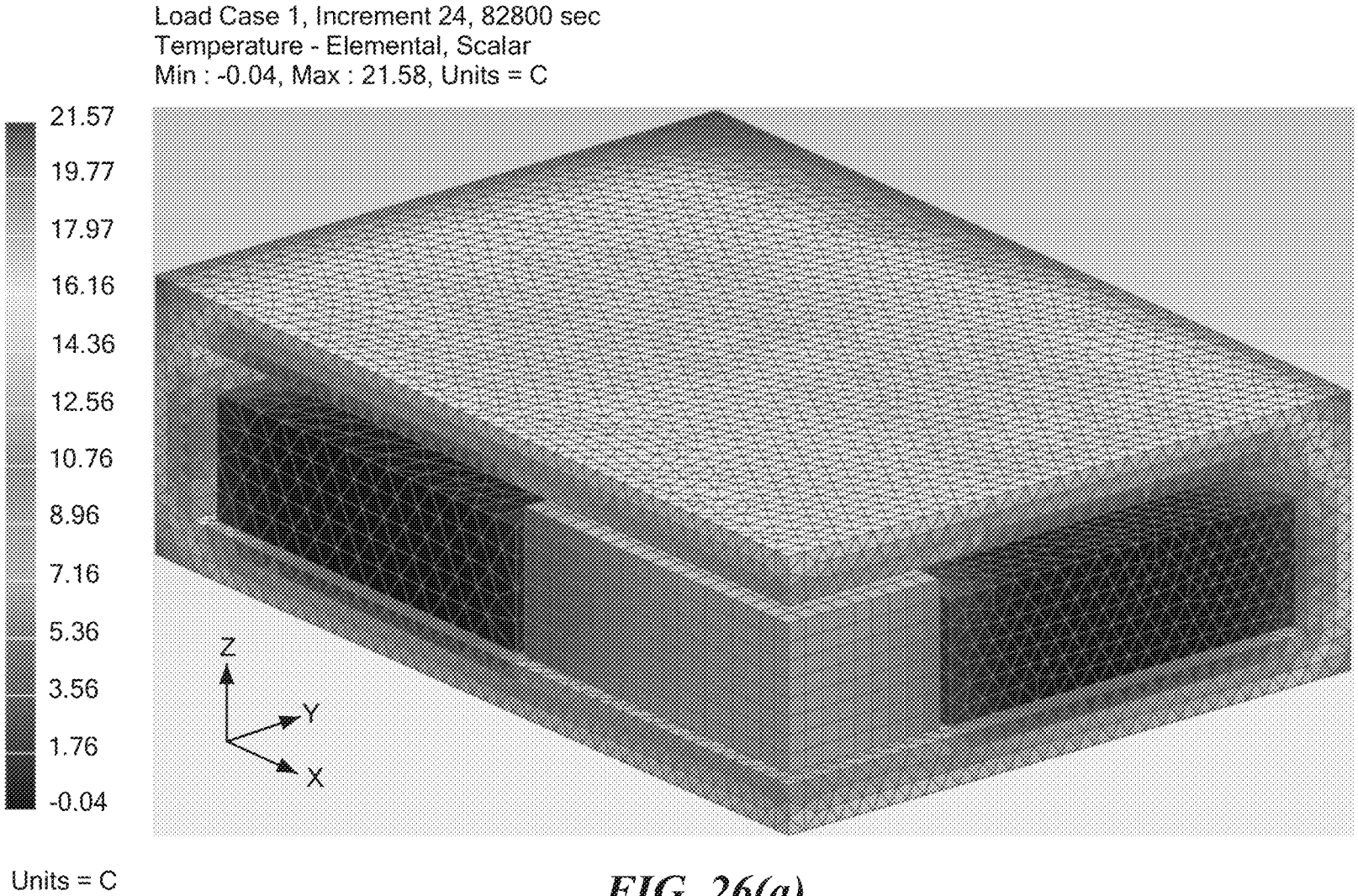
FIGS. 26(*a*) and 26(*b*) are graphic depictions of the temperature distribution, after 23 hours, in the simulated models of FIGS. 19 and 21, respectively.
Figure 26B:
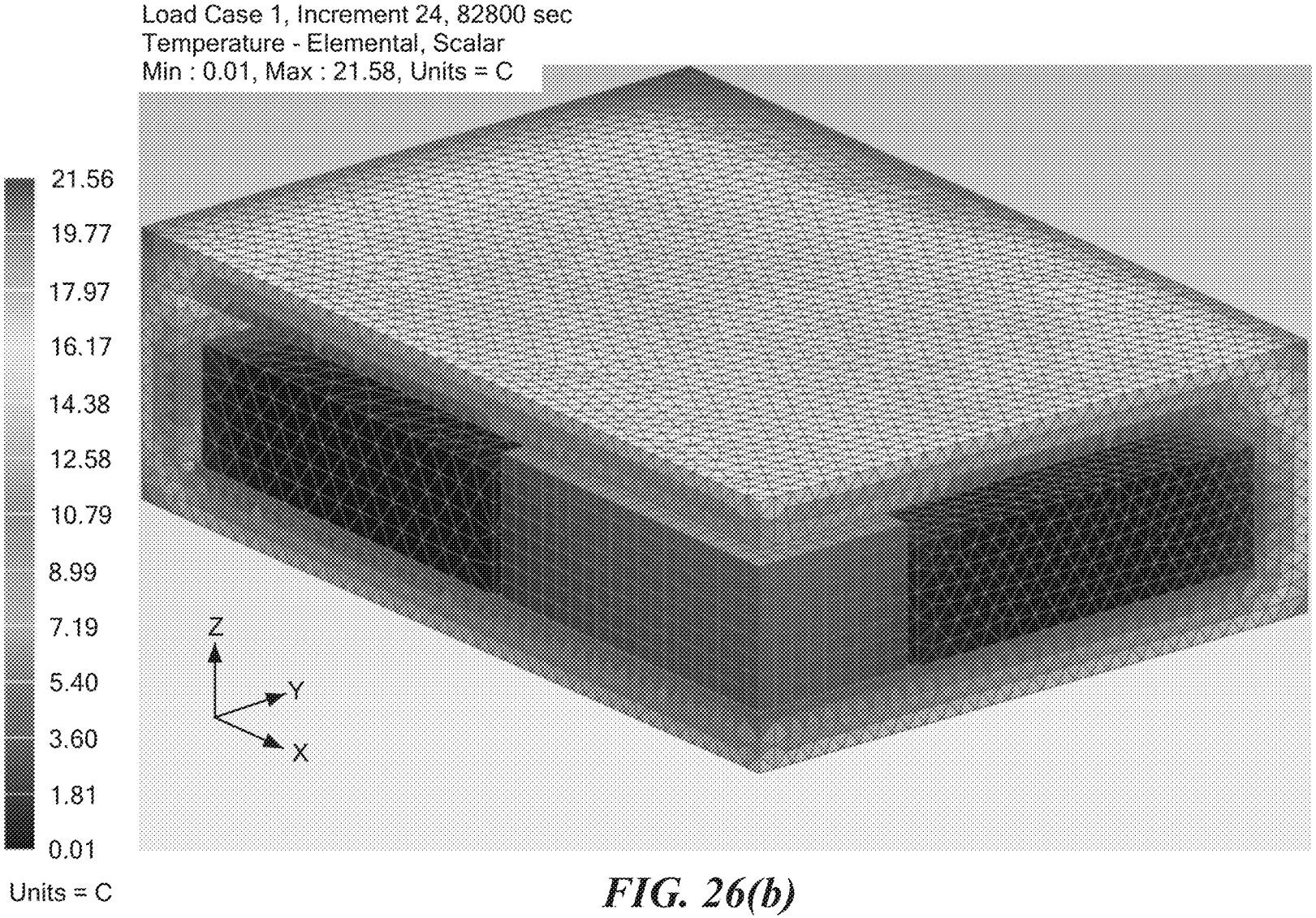
Figure 27A:
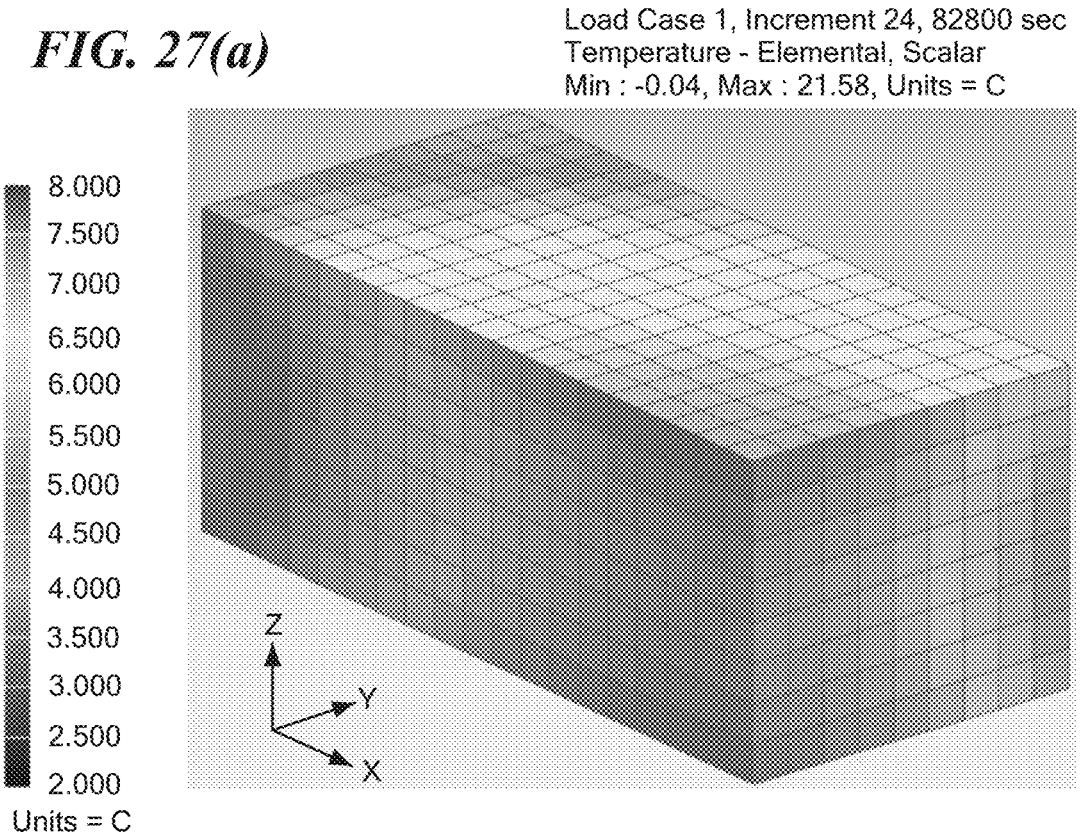
FIGS. 27(*a*) and 27(*b*) of the temperature distribution, after 23 hours, in the payloads of the simulated models of FIGS. 19 and 21, respectively.
Figure 27B:
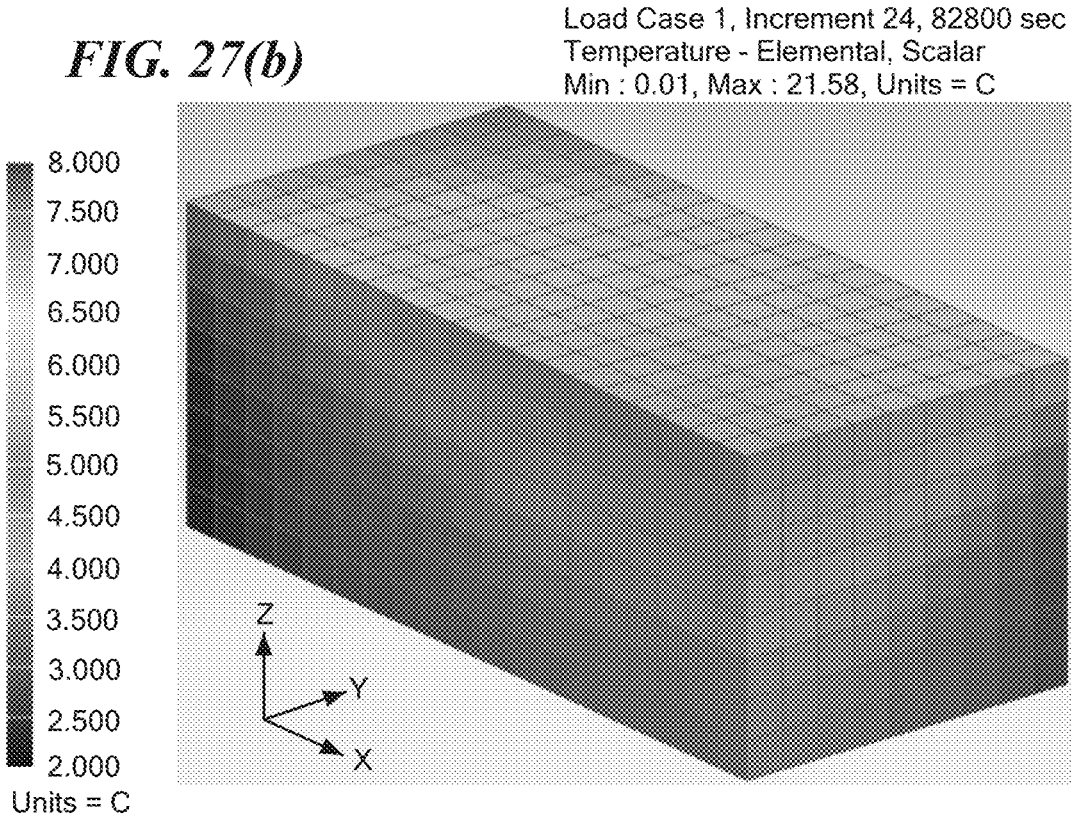

FIGS. 24(*a*) and 24(*b*) show the simulated temperature distribution, after 7 hours, in Models 3 and 4, respectively, and FIGS. 25(*a*) and 25(*b*) show the simulated temperature distribution, after 7 hours, specifically in the payloads of Models 3 and 4, respectively. FIGS. 26(*a*) and 26(*b*) show the simulated temperature distribution, after 23 hours, in Models 3 and 4, respectively, and FIGS. 27(*a*) and 27(*b*) show the simulated temperature distribution, after 23 hours, specifically in the payloads of Models 3 and 4, respectively.

Although the present invention has been described herein as being suitable for use in standard-size courier boxes, such as a FedEx® Box—Large or a UPS® Large Express Box, it is to be understood that the present invention is not limited to use with such boxes. Accordingly, the present invention may be scaled-up or scaled-down in size and may be shipped within standard-size courier boxes, within custom-size courier boxes or other containers, or even without an outer box or other container entirely. In addition, it is to be understood that, although a box or container within which the shipping system may be disposed is not shown in all embodiments, such a box or container may be included as a component of the present system.

In some embodiments, the present invention may include one or more of the following aspects, features, or advantages: (i) the use of at least one conductive layer ("heat spreader") in a design with a very large aspect ratio of length and/or width compared to height; (ii) the use of a heat spreader layer in a seasonal design by pulling it in or out with the season, wherein such a seasonal design uses the same parts but with the addition or removal of one or both conductive layers; (iii) the use of a non-rectangular heat spreader (e.g., holes in center, etc.); (iv) a payload aspect ratio that is greater than 1 (i.e., length/width greater than height); (v) the payload is not covered by refrigerants on its top and bottom (i.e., conductive layer is on one or both or none of these faces); (vi) the use of a conductive layer when the space between the shipper wall internal height and the payload height is less than the thickness of the refrigerant components used in the system; and (vii) the conductive layer may be an integral part of the top lid or the base, instead of being a separate component.

The embodiments of the present invention described above are intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A shipping system for a payload, the shipping system comprising:

(a) an insulated container, wherein the insulated container includes a bottom wall comprising insulation, a top wall comprising insulation, and a cavity between the bottom wall and the top wall, wherein the cavity includes a length, a width, and a height, and wherein each of the length and the width is greater than the height;

(b) a first thermally conductive layer, the first thermally conductive layer disposed on one of a top surface of the bottom wall and a bottom surface of the top wall;

(c) a payload box for holding the payload, the payload box disposed within the cavity and in direct contact with the first thermally conductive layer;

(d) a first temperature-control member, the first temperature-control member comprising a phase-change material, wherein the first temperature-control member is disposed within the cavity and is in direct contact with the first thermally conductive layer;

(e) wherein the first thermally conductive layer has opposing first and second surfaces and wherein both the payload box and the first temperature-control member are in direct contact with the first surface of the first thermally conductive layer; and (f) wherein the shipping system is devoid of phase-change material above the payload box and below the payload box.

2. The shipping system as claimed in claim 1 wherein the bottom wall is part of a base, the base further comprising a plurality of side walls extending upwardly from the bottom wall.

3. The shipping system as claimed in claim 2 wherein the top wall is seated on top of the side walls of the base.

4. The shipping system as claimed in claim 2 wherein at least some of the side walls comprise protrusions extending into the cavity.

5. The shipping system as claimed in claim 1 wherein the first thermally conductive layer is disposed on the top surface of the bottom wall.

6. The shipping system as claimed in claim 1 wherein the first thermally conductive layer is disposed on the bottom surface of the top wall.

7. The shipping system as claimed in claim 1 further comprising a second thermally conductive layer, wherein the first thermally conductive layer is disposed on the top surface of the bottom wall and wherein the second thermally conductive layer is disposed on the bottom surface of the top wall.

8. The shipping system as claimed in claim 1 wherein the insulated container further comprises an outer box and wherein the bottom wall and the top wall are disposed within the outer box.

9. The shipping system as claimed in claim 8 wherein the insulated container further comprises at least one side wall comprising insulation and wherein the at least one side wall interconnects the bottom wall and the top wall.

10. The shipping system as claimed in claim 8 wherein the insulated container is devoid of a side wall comprising insulation interconnecting the bottom wall and the top wall.

11. The shipping system as claimed in claim 1 wherein the payload box has a length, a width, and a height and wherein the length of the payload box and the width of the payload box is greater than the height of the payload box.

12. The shipping system as claimed in claim 1 further comprising a second temperature-control member, the second temperature-control member comprising a phase-change material, wherein the second temperature-control member is disposed within the cavity and is in direct contact with the first thermally conductive layer.

13. The shipping system as claimed in claim 12 wherein the first temperature-control member and the second temperature-control member are preconditioned at different preconditioning temperatures.

14. The shipping system as claimed in claim 12 wherein the payload box is positioned between the first and second temperature-control members.

15. The shipping system as claimed in claim 1 further comprising an insulation member positioned between the first temperature-control member and the payload box.

16. The shipping system as claimed in claim 15 wherein the insulation member comprises an insulation frame, the insulation frame being shaped to surround the payload box while having an open top and an open bottom.

17. The shipping system as claimed in claim 1 wherein the top surface of the bottom wall, the bottom surface of the top wall, and the first thermally conductive layer have matching footprints.

18. The shipping system as claimed in claim 1 wherein the first thermally conductive layer comprises at least one transverse opening.

19. The shipping system as claimed in claim 1 wherein the first thermally conductive layer has a footprint that is less than that of the top surface of the bottom wall and is less than that of the bottom surface of the top wall and is closer to but greater than that of the payload box.

20. The shipping system as claimed in claim 1 wherein the first thermally conductive member is permanently coupled to the insulated container.

21. The shipping system as claimed in claim 1 wherein the first thermally conductive member is removably coupled to the insulated container.

22. The shipping system as claimed in claim 1 wherein the top wall is movable relative to the bottom wall to provide access to the cavity.

23. The shipping system as claimed in claim 1 wherein the insulated container comprises at least one of an expanded polystyrene, a polyurethane foam, and a vacuum insulated panel.

24. The shipping system as claimed in claim 1 wherein the first temperature-control member further comprises a sealed container and wherein the phase-change material is disposed within the sealed container.

25. The shipping system as claimed in claim 1 wherein the payload box is centered relative to the first thermally conductive layer.

26. The shipping system as claimed in claim 1 wherein at least one of the first temperature-control member and the payload box has a height that substantially matches the height of the cavity.

27. A shipping system for a payload, the shipping system comprising:

(a) an insulated container, wherein the insulated container includes a bottom wall comprising insulation, a top wall comprising insulation, and a cavity between the bottom wall and the top wall, wherein the cavity includes a length, a width, and a height, and wherein each of the length and the width is greater than the height;

(b) a first thermally conductive layer;

(c) a second thermally conductive layer, wherein the first thermally conductive layer is disposed on the top surface of the bottom wall and wherein the second thermally conductive layer is disposed on the bottom surface of the top wall;

(d) a payload box for holding the payload, the payload box disposed within the cavity and in direct contact with the first thermally conductive layer;

(e) a first temperature-control member, the first temperature-control member comprising a phase-change material, wherein the first temperature-control member is disposed within the cavity and is in direct contact with the first thermally conductive layer; and (f) wherein each of the first thermally conductive layer and the second thermally conductive layer has opposing top and bottom surfaces, wherein both the payload box and the first temperature-control member are in direct contact with the top surface of the first thermally conductive layer, and wherein both the payload box and the first temperature-control member are in direct contact with the bottom surface of the second thermally conductive layer.

28. The shipping system as claimed in claim 27 wherein the first temperature-control member further comprises a sealed container and wherein the phase-change material is disposed within the sealed container.

29. The shipping system as claimed in claim 27 wherein the payload box is centered relative to the first thermally conductive layer.

30. The shipping system as claimed in claim 27 further comprising a second temperature-control member, the second temperature-control member comprising a phase-change material, and wherein the second temperature-control member is disposed within the cavity and is in direct contact with each of the top surface of the first thermally conductive layer and the bottom surface of the second thermally conductive layer.

31. The shipping system as claimed in claim 30 wherein the payload box is positioned between the first and second temperature-control members.

32. A shipping system for a payload, the shipping system comprising:

(a) an insulated container, wherein the insulated container includes a bottom wall comprising insulation, a top wall comprising insulation, and a cavity between the bottom wall and the top wall, wherein the cavity includes a length, a width, and a height, and wherein each of the length and the width is greater than the height;

(b) a first thermally conductive layer, the first thermally conductive layer disposed on one of a top surface of the bottom wall and a bottom surface of the top wall, the first thermally conductive layer having opposing first and second surfaces;

(c) a payload box for holding the payload, the payload box disposed within the cavity and in direct contact with the first surface of the first thermally conductive layer;

(d) first and second temperature-control members, each of the first and second temperature-control members comprising a phase-change material, wherein each of the first and second temperature-control members is disposed within the cavity and is in direct contact with the first surface of the first thermally conductive layer, and wherein the payload box is positioned between the first and second temperature-control members.

33. The shipping system as claimed in claim 32 wherein the first thermally conductive layer is a substantially planar member.

34. The shipping system as claimed in claim 33 wherein the first thermally conductive layer is a foil having a thickness of about 10 mils.

35. The shipping system as claimed in claim 32 wherein the height is less than 3 inches.

36. The shipping system as claimed in claim 32 wherein each of the first and second temperature-control members further comprises a sealed container, the phase-change material being disposed within the sealed container.

37. The shipping system as claimed in claim 36 wherein the payload box is centered relative to the first thermally conductive layer.

38. The shipping system as claimed in claim 37 further comprising third and fourth temperature-control members, each of the third and fourth temperature-control members comprising a phase-change material, wherein each of the third and fourth temperature-control members is disposed within the cavity and is in direct contact with the first surface of the first thermally conductive layer, wherein the payload box is positioned between the third and fourth temperature-control members, and wherein each of the payload box and the first, second, third and fourth temperature-control members has a height that substantially matches the height of the cavity.

39. A shipping system for a payload, the shipping system comprising:

(a) an insulated container, wherein the insulated container includes a bottom wall comprising insulation, a top wall comprising insulation, and a cavity between the bottom wall and the top wall, wherein the cavity includes a length, a width, and a height, and wherein each of the length and the width is greater than the height;

(b) a first thermally conductive layer, the first thermally conductive layer disposed on one of a top surface of the bottom wall and a bottom surface of the top wall;

(c) a payload box for holding the payload, the payload box disposed within the cavity and in direct contact with the first thermally conductive layer;

(d) a first temperature-control member, the first temperature-control member comprising a phase-change material, wherein the first temperature-control member is disposed within the cavity and is in direct contact with the first thermally conductive layer;

(e) wherein the first thermally conductive layer has opposing first and second surfaces and wherein both the payload box and the first temperature-control member are in direct contact with the first surface of the first thermally conductive layer; and (f) wherein each of the payload box and the first temperature-control member has a height that substantially matches the height of the cavity.

* * * * *